US010842193B2

(12) United States Patent
Sahin et al.

(10) Patent No.: US 10,842,193 B2
(45) Date of Patent: Nov. 24, 2020

(54) NON-COMBUSTIBLE SMOKING DEVICE AND ELEMENTS THEREOF

(71) Applicant: Altria Client Services LLC, Richmond, VA (US)

(72) Inventors: Buket Sahin, Richmond, VA (US); San Li, Midlothian, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 361 days.

(21) Appl. No.: 15/284,897

(22) Filed: Oct. 4, 2016

(65) Prior Publication Data

US 2018/0092400 A1 Apr. 5, 2018

(51) Int. Cl.
*A24F 47/00* (2020.01)

(52) U.S. Cl.
CPC ..... *A24F 47/008* (2013.01)

(58) Field of Classification Search
CPC ... A24F 47/008; A61M 15/06; A61M 11/042; A61M 11/044
USPC ..... 392/404; 131/329
See application file for complete search history.

(56) References Cited

U.S. PATENT DOCUMENTS

| | | | |
|---|---|---|---|
| 4,393,884 | A | 7/1983 | Jacobs |
| 4,708,151 | A | 11/1987 | Shelar |
| 4,714,082 | A | 12/1987 | Banerjee et al. |
| 4,756,318 | A | 7/1988 | Clearman et al. |
| 4,793,365 | A | 12/1988 | Sensabaugh, Jr. et al. |
| 4,854,331 | A | 8/1989 | Banerjee et al. |
| 4,911,181 | A | 3/1990 | Vromen et al. |
| 4,917,128 | A | 4/1990 | Clearman et al. |
| 4,947,874 | A | 8/1990 | Brooks et al. |
| 4,961,438 | A | 10/1990 | Korte |
| 5,020,548 | A | 6/1991 | Farrier et al. |
| 5,033,483 | A | 7/1991 | Clearman et al. |
| 5,042,509 | A | 8/1991 | Banerjee et al. |
| 5,060,666 | A | 10/1991 | Clearman et al. |

(Continued)

FOREIGN PATENT DOCUMENTS

| | | | |
|---|---|---|---|
| CN | 201127292 | Y | 10/2008 |
| CN | 102813278 | A | 12/2012 |

(Continued)

OTHER PUBLICATIONS

International Search Report and Written Opinion dated Jan. 3, 2018.

(Continued)

*Primary Examiner* — Tu B Hoang
*Assistant Examiner* — Erin E McGrath
(74) *Attorney, Agent, or Firm* — Harness, Dickey & Pierce, P.L.C.

(57) ABSTRACT

At least one example embodiment discloses a pre-vapor formulation reservoir configured to contain a pre-vapor formulation material, a heating element coupled to the pre-vapor formulation reservoir and configured to heat at least a portion of the pre-vapor formulation material into a generated vapor and provide the generated vapor to a first portion of a channel, a tobacco housing at a second portion of the channel and positioned to receive the generated vapor, the tobacco housing including tobacco and at least one air flow element in the tobacco housing to direct at least a first portion of the generated vapor towards an end of the non-combustible smoking element.

18 Claims, 14 Drawing Sheets

(56) References Cited

U.S. PATENT DOCUMENTS 5,060,671 A 10/1991 Counts et al.
5,065,776 A 11/1991 Lawson et al.
5,067,499 A 11/1991 Banerjee et al.
5,076,292 A 12/1991 Sensabaugh, Jr. et al.
5,080,114 A 1/1992 Rudolph et al.
5,159,942 A 11/1992 Brinkley et al.
5,203,355 A 4/1993 Clearman et al.
5,235,992 A 8/1993 Sensabaugh, Jr.
5,240,016 A 8/1993 Nichols et al.
5,293,883 A 3/1994 Edwards
5,433,224 A 7/1995 Luke et al.
6,532,965 B1 3/2003 Abhulimen et al.
7,726,320 B2 6/2010 Robinson et al.
7,845,359 B2 12/2010 Montaser
8,079,371 B2 12/2011 Robinson et al.
8,342,184 B2 1/2013 Inagaki et al.
8,479,747 B2 7/2013 O'Connell
8,678,012 B2 3/2014 Li et al.
8,678,013 B2 3/2014 Crooks et al.
8,714,161 B2 5/2014 Liu
8,833,364 B2 9/2014 Buchberger
8,881,737 B2 11/2014 Collett et al.
8,893,724 B2 11/2014 Woodcock et al.
8,899,238 B2 12/2014 Robinson et al.
9,010,335 B1 4/2015 Scatterday
9,078,473 B2 7/2015 Worm et al.
2006/0272659 A1* 12/2006 Kobal ..... A24F 13/02 131/187
2008/0092912 A1 4/2008 Robinson et al.
2012/0199146 A1 8/2012 Marangos
2013/0081642 A1 4/2013 Safari
2013/0160764 A1 6/2013 Liu
2013/0160765 A1 6/2013 Liu
2013/0167853 A1* 7/2013 Liu ..... A24F 47/008 131/329
2013/0192617 A1 8/2013 Thompson
2013/0192623 A1* 8/2013 Tucker ..... H05B 3/44 131/329
2013/0255675 A1 10/2013 Liu
2013/0319407 A1 12/2013 Liu
2014/0000638 A1 1/2014 Sebastian et al.
2014/0096781 A1 4/2014 Sears et al.
2014/0096782 A1 4/2014 Ampolini et al.
2014/0144453 A1 5/2014 Capuano et al.
2014/0166028 A1 6/2014 Fuisz et al.
2014/0166029 A1 6/2014 Weigensberg et al.
2014/0253144 A1 9/2014 Novak, III et al.
2014/0261486 A1 9/2014 Potter et al.
2014/0261489 A1 9/2014 Cadieux et al.
2014/0261490 A1 9/2014 Kane
2014/0283825 A1 9/2014 Buchberger
2014/0299125 A1 10/2014 Buchberger
2014/0305448 A1 10/2014 Zuber et al.
2014/0305454 A1 10/2014 Rinker et al.
2014/0355969 A1 12/2014 Stern
2014/0366898 A1 12/2014 Monsees et al.
2015/0013698 A1 1/2015 Woodcock et al.
2015/0027454 A1* 1/2015 Li ..... A24F 47/008 131/328
2015/0027455 A1 1/2015 Peleg et al.
2015/0027457 A1 1/2015 Janardhan et al.
2015/0027459 A1 1/2015 Collett et al.
2015/0027469 A1 1/2015 Tucker et al.
2015/0040930 A1 2/2015 Robinson et al.
2015/0047656 A1 2/2015 Robinson et al.
2015/0053220 A1 2/2015 Levy et al.
2015/0114409 A1 4/2015 Brammer et al.
2015/0122277 A1 5/2015 Frobisher et al.
2015/0128968 A1 5/2015 Chapman et al.
2015/0136155 A1 5/2015 Verleur et al.
2015/0136158 A1 5/2015 Stevens et al.
2015/0164147 A1 6/2015 Verleur et al.
2015/0335070 A1 11/2015 Sears et al.
2016/0007648 A1 1/2016 Sutton et al.
2016/0007649 A1 1/2016 Sampson et al.
2016/0073695 A1* 3/2016 Sears ..... H05B 3/46 131/329
2016/0120224 A1* 5/2016 Mishra ..... A24F 47/008 392/390
2016/0143360 A1 5/2016 Sanchez et al.

FOREIGN PATENT DOCUMENTS

CN 203618787 U 6/2014
CN 204146321 U 2/2015
CN 104397878 A 3/2015
GB 2513627 A 11/2014
WO WO-2014116974 A1 7/2014
WO WO-2014207719 A1 12/2014
WO WO-2015046385 A1 4/2015
WO WO-2015197852 A2 12/2015
WO WO-2016024083 A1 2/2016
WO WO-2016062777 A1 4/2016
WO WO-2016135331 A1 9/2016
WO WO-2016135342 A2 * 9/2016 ..... A24F 47/004

OTHER PUBLICATIONS

"How to Brew Your Own Tobacco E-Liquids," Vape Squad, https://web.archive.org/web/20130624084503/http://www.vapesquad.com/how-to-brew-your-own-tobacco-e-liquids/<https://web.archive.org/web/20130624084503/http:/www.vapesquad.com/how-to-brew-your-own-tobacco-e-liquids/>, Jun. 20, 2013.
"Mixing of e-liquids," Naturally Extracted Tobacco, LLC, http://www.naturally-extracted-tobacco.com/Mixing-s/1822.htm, Jul. 6, 2013.
"Marlboro HeatStick," http://www.dailymail.co.uk/news/article-2671505/Philip-Morris-Intl-sell-Marlboro-HeatSticks.html, Jun. 26, 2014.
"White, Black 350MAH Dry Herb Vaporizers/Wax Oil Vaporier with LCD Screen," E-Cig Mechanical Mods, http://www.ecigmechanicalmods.com/sale-3013923-white-black-350mah-dry-herb-vaporizers-wax-oil-vaporizer-with-lcs-screen.html, Jun. 26, 2015.
"New 10g E-Solid Tobacco Flavor Solid Electronic Cigarette Oil," eliquidtrade, http://www.eliquidtrade.com/new-e-solid-tobacco-flavor-solid-electronic-cigarette-oil, Aug. 31, 2014.
"Dry Herb Vaporizer used for e-solid/Tobacco/herbs eGO electronic cigarette," HongKong Chiamey Enterprise, http://elite-electronic-cigarettes.sell.curiousexpeditions.org/iz537e0d6-dry-herb-vaporizer-uder-for-e-solid-tobacco-herbs-ego-electronic-cigarette-images, Jun. 26, 2015.
International Search Report dated Aug. 2, 2016.
Written Opinion of the International Preliminary Examining Authority dated Sep. 14, 2018 in PCT Application PCT/EP2017/075254.
International Preliminary Report on Patentability dated Dec. 13, 2018 in PCT Application PCT/EP2017/075254.

* cited by examiner

NON-COMBUSTIBLE SMOKING DEVICE AND ELEMENTS THEREOF

BACKGROUND

Field

At least some example embodiments relate generally to a non-combustible smoking device.

Related Art

Electronic vaping devices are used to vaporize a pre-vapor formulation into a vapor. These electronic vaping devices may be referred to as e-vaping devices. E-vaping devices include a heater, which vaporizes the pre-vapor formulation to produce the vapor. The e-vaping device may include several e-vaping elements including a power source, a cartridge or e-vaping tank including the heater and a reservoir capable of holding the pre-vapor formulation.

SUMMARY

At least one example embodiment relates to a non-combustible smoking device. A non-combustible smoking device may have a heater that heats a pre-vapor formulation and may provide heat to a tobacco element that receives the generated vapor. More specifically, the non-combustible smoking device according to example embodiments exposes a generated vapor to a tobacco element and/or exposes a pre-vapor formulation to a tobacco element.

At least one example embodiment discloses a non-combustible smoking element including a pre-vapor formulation reservoir configured to contain a pre-vapor formulation material, a heating element coupled to the pre-vapor formulation reservoir and configured to heat at least a portion of the pre-vapor formulation material into a generated vapor and provide the generated vapor to a first portion of a channel, a tobacco housing at a second portion of the channel and positioned to receive the generated vapor, the tobacco housing including tobacco and at least one air flow element in the tobacco housing to direct at least a first portion of the generated vapor towards an end of the non-combustible smoking element.

In an example embodiment, the air flow element extends from a first end portion of the tobacco housing to an opposing second end portion of the tobacco housing.

In an example embodiment, the air flow element separates the tobacco housing into a first portion and a second portion, the first portion being configured to prevent the first portion of the generated vapor from being exposed to the tobacco.

In an example embodiment, the first portion of the generated vapor is about 65 percent of the entire generated vapor.

In an example embodiment, the air flow element is a tube.

In an example embodiment, the tube has an inside diameter of 0.5 mm to 3 mm.

In an example embodiment, the tube has an inside diameter of 2 mm to 2.5 mm.

In an example embodiment, the air flow element divides the tobacco housing into two sections.

In an example embodiment, the air flow element includes at least one of PEEK and metal.

At least one example embodiment discloses a non-combustible smoking element including a pre-vapor formulation reservoir configured to contain a pre-vapor formulation material, a heating element coupled to the pre-vapor formulation reservoir and configured to heat at least a portion of the pre-vapor formulation material into a generated vapor and provide the generated vapor to a first portion of a channel, a divider extending in a second portion of the channel, the divider extending in a longitudinal direction and dividing the second portion of the channel into a single air channel part and a tobacco part, the single air channel part and the tobacco part being positioned to receive the generated vapor, the tobacco part including a tobacco part having tobacco, the tobacco part being positioned to receive a first portion of the generated vapor.

In an example embodiment, the divider includes metal and is configured to conduct the heat generated by the heating element to heat the tobacco.

In an example embodiment, the single air channel part is larger by volume than the tobacco part.

In an example embodiment, the non-combustible smoking element includes a housing having an inner diameter and extending in the longitudinal direction, the housing houses the pre-vapor formulation reservoir, the heating element and the divider, the divider being positioned at a distance of 65% of the diameter in a first direction to the housing and a distance of 35% of the diameter in a second direction to the housing.

At least one example embodiment discloses a non-combustible smoking device including a pre-vapor formulation reservoir configured to contain a pre-vapor formulation material, a heating element coupled to the pre-vapor formulation reservoir and configured to heat at least a portion of the pre-vapor formulation material into a generated vapor and provide the generated vapor to a first portion of a channel, a power supply configured to supply power to the heating element, a tobacco housing at a second portion of the channel and positioned to receive the generated vapor, the tobacco housing including tobacco and at least one air flow element in the tobacco housing to direct at least a first portion of the generated vapor towards an end of the non-combustible smoking element.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
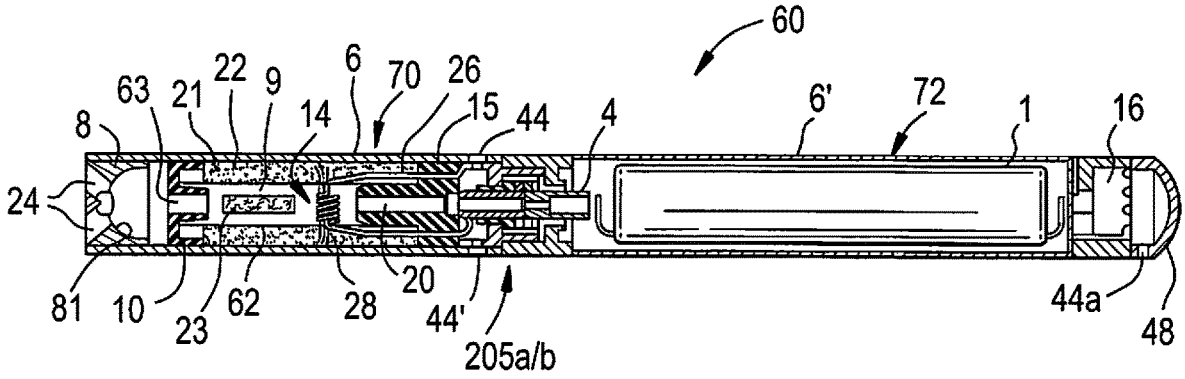
FIG. 1 is a cross-sectional view of a non-combustible smoking device including a tobacco element, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, elements, regions, layers and/or sections, these elements, elements, regions, layers, and/or sections should not be limited by these terms. These terms are only used to distinguish one element, element, region, layer, or section from another region, layer, or section. Thus, a first element, element, region, layer, or section discussed below could be termed a second element, element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or elements, but do not preclude the presence or addition of one or more other features, integers, steps, operations, elements, elements, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 illustrates a non-combustible smoking device 60 according to an example embodiment. The non-combustible smoking device 60 comprises a replaceable cartridge (or first section) 70 and a reusable fixture (or second section) 72, which are coupled together at a connection 205*a/b* (e.g., 205*a* is a male threaded connection on cartridge 70, and 205*b* is a female threaded connection on reusable fixture 72) or by other convenience such as a snug-fit, detent, clamp and/or clasp. The first section 70 includes an outer tube 6 (or housing) extending in a longitudinal direction and an inner tube 62 coaxially positioned within the outer tube or housing 6. The inner tube 62 defines an outer air passage (or channel) 9. Within the outer air passage 9 and downstream from a heater 14 is a tobacco element 23. The tobacco element 23 may be in a porous aluminum tube or processed/shaped in a porous form.

The term "tobacco element" may refer to any tobacco plant material including tobacco leaf, tobacco plug, reconstituted tobacco, compressed tobacco rod, shaped, or powder, for example.

The tobacco element 23 may also be wrapped in tobacco such as a tobacco sheet, a reconstituted tobacco leaf or a cigar wrapper.

The second section 72 can also include an outer tube 6' (or housing) extending in a longitudinal direction. In an alternative embodiment, the outer tube 6 and 6' can be a single tube housing both the first section 70 and the second section 72 and the entire non-combustible smoking device 60 can be disposable.

The non-combustible smoking device 60 can also include a central air passage 20 defined in part by the inner tube 62 and an upstream seal 15. Moreover, the non-combustible smoking device 60 includes a pre-vapor formulation supply reservoir 22. The pre-vapor formulation supply reservoir 22 comprises a pre-vapor formulation material and optionally a pre-vapor formulation storage medium 21 operable to store the pre-vapor formulation material therein.

In an embodiment, the pre-vapor formulation supply reservoir 22 is contained in an outer annulus between the outer tube 6 and the inner tube 62. The annulus is sealed at an upstream end by the seal 15 and by a pre-vapor formulation gasket 10 at a downstream end so as to prevent leakage of the pre-vapor formulation material from the pre-vapor formulation supply reservoir 22.

In an embodiment, a heater 14 is also contained in the inner tube 62 downstream of and in spaced apart relation to the portion of central air passage 20 defined by the seal 15. The heater 14 can be in the form of a wire coil, a planar body, a ceramic body, a single wire, a cage of resistive wire or any other suitable form.

A wick 28 is in communication with the pre-vapor formulation material in the pre-vapor formulation supply reservoir 22 and in communication with the heater 14 such that the wick 28 disposes pre-vapor formulation material in proximate relation to the heater 14. The wick 28 may be constructed of a fibrous and flexible material. The wick 28 may include at least one filament having a capacity to draw a pre-vapor formulation. For example, the wick 28 may comprise a bundle of filaments which may include glass (or ceramic) filaments. In another embodiment, a bundle comprising a group of windings of glass filaments, for example, three of such windings, all which arrangements are capable of drawing pre-vapor formulation via capillary action via interstitial spacing between the filaments.

A power supply 1 in the second section 72 may be operably connected to the heater 14 (as described below) to apply voltage across the heater 14. The non-combustible smoking device 60 also includes at least one air inlet 44 operable to deliver air to the central air passage 20 and/or other portions of the inner tube 62.

Figure 2A:
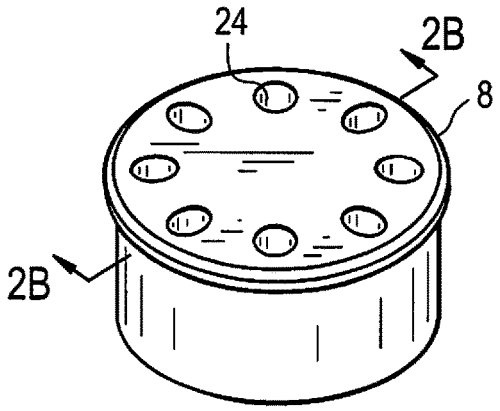
FIG. 2A is a perspective view of a mouth-end insert for use with the non-combustible smoking device of FIG. 1, in accordance with an example embodiment.
Figure 2B:
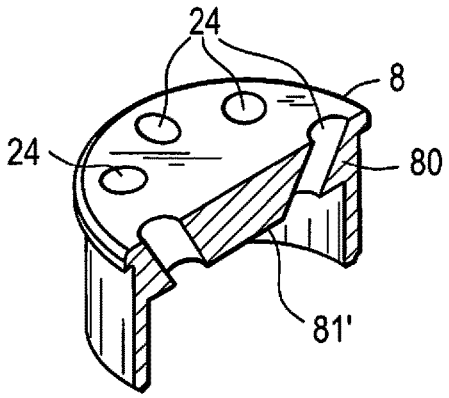
FIG. 2B is a cross-sectional view along line B-B of the mouth-end insert of FIG. 2A, in accordance with an example embodiment.

As shown in FIGS. 1-2B, the non-combustible smoking device 60 further includes a mouth-end insert 8 having at least two off-axis, diverging outlets 24. The mouth-end insert 8 is in fluid communication with the central air passage 20 via the interior of inner tube 62 and a central passage 63, which extends through the gasket 10.

Moreover, the heater 14 extends in a direction transverse to the longitudinal direction and heats the pre-vapor formulation material to a temperature sufficient to vaporize the pre-vapor formulation material and form a generated vapor. In other embodiments, the heater 14 may be arranged in another manner such as in the longitudinal direction.

The generated vapor then flows into the tobacco element 23 upon an applying a negative pressure on the mouth-end insert 8. The heater 14 may be a set distance from the tobacco element 23 or contacting the tobacco element 23 such that the heater 14 heats the tobacco element 23 during application of a negative pressure. For example, the heater 14 may be ten (10) millimeters or less from the tobacco element 23. The heater 14 may be arranged to produce a temperature of 50 degrees Celsius at the mouth-end insert 8. Moreover, the heater 14 may heat the tobacco element 23 to a temperature between 50 and 200 degrees Celsius and heat the pre-vapor formulation at 400 degrees Celsius.

The heater 14 warms the tobacco element 23, but does not burn the tobacco. Thus, the warming of the tobacco element 23 may be referred to as non-combustible. Because the section 70 includes the tobacco element 23 and the heater 14, the section 70 may be referred to as a non-combustible smoking element.

Referring to FIG. 1, the wick 28, pre-vapor formulation supply reservoir 22 and mouth-end insert 8 are contained in the cartridge 70 and the power supply 1 is contained in the second section 72. In one embodiment, the first section (the cartridge) 70 is disposable and the second section (the fixture) 72 is reusable. The sections 70, 72 can be attached by a threaded connection 205, as described above, whereby the downstream section 70 can be replaced when the pre-vapor formulation supply reservoir 22 is used up. Having a separate first section 70 and second section 72 provides a number of advantages. First, if the first section 70 contains the at least one heater 14, the pre-vapor formulation supply reservoir 22 and the wick 28, all elements which are potentially in contact with the pre-vapor formulation are disposed of when the first section 70 is replaced. Thus, there will be no cross-contamination between different mouth-end inserts 8, for example, when using different pre-vapor formulation materials. Also, if the first section 70 is replaced at suitable intervals, there is little chance of the heater becoming clogged with pre-vapor formulation. Optionally, the first section 70 and the second section 72 are arranged to lock together when engaged.

In an embodiment, the at least one air inlet 44 includes one or two air inlets 44, 44'. Alternatively, there may be three, four, five or more air inlets. If there is more than one air inlet 44, 44', the air inlets 44, 44' are located at different locations along the non-combustible smoking device 60. For example, as shown in FIG. 1, an air inlet 44*a* can be positioned at the upstream end of the non-combustible smoking device 60 adjacent a sensor 16 such that the sensor 16 supplies power to the heater 14 upon sensing an application of a negative pressure. Air inlet 44*a* should communicate with the mouth-end insert 8 so that a draw upon the mouth-end insert activates the sensor 16. The air from the air inlet 44*a* can then flow along the power supply 1 and to the central air passage 20 in the seal 15 and/or to other portions of the inner tube 62 and/or outer tube 6. At least one additional air inlet 44, 44' can be located adjacent and upstream of the seal 15 or at any other desirable location. Altering the size and number of air inlets 44, 44' can also aid in establishing the resistance to draw of the non-combustible smoking device 60.

In an embodiment, the heater 14 is arranged to communicate with the wick 28 and to heat the pre-vapor formulation material contained in the wick 28 to a temperature sufficient to vaporize the pre-vapor formulation material and form a generated vapor.

The heater 14 may be a wire coil surrounding wick 28. Examples of suitable electrically resistive materials include titanium, zirconium, tantalum and metals from the platinum group. Examples of suitable metal alloys include stainless steel, nickel-, cobalt-, chromium-, aluminium- titanium-zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater may be formed of nickel aluminides, a material with a layer of alumina on the surface, iron aluminides and other composite materials, the electrically resistive material may optionally be embedded in, encapsulated or coated with an insulating material or vice-versa, depending on the kinetics of energy transfer and the external physicochemical properties required. In one embodiment, the heater 14 comprises at least one material selected from the group consisting of stainless steel, copper, copper alloys, nickel-chromium alloys, superalloys and combinations thereof. In an embodiment, the heater 14 is formed of nickel-chromium alloys or iron-chromium alloys. In one embodiment, the heater 14 can be a ceramic heater having an electrically resistive layer on an outside surface thereof.

In another embodiment, the heater 14 may be constructed of an iron-aluminide (e.g., FeAl or Fe.sub.3Al), such as those described in commonly owned U.S. Pat. No. 5,595,706 to Sikka et al. filed Dec. 29, 1994, or nickel aluminides (e.g., Ni.sub.3Al). Use of iron-aluminides is particularly advantageous in that they exhibit high resistivity. FeAl exhibits a resistivity of approximately 180 micro-ohms, whereas stainless steel exhibits approximately 50 to 91 micro-ohms. The higher resistivity lowers current draw or load on the power source (battery) 1.

In one embodiment, the heater 14 comprises a wire coil which at least partially surrounds the wick 28. In that embodiment, the wire may be a metal wire and/or the heater coil that extends partially along the length of the wick 28. The heater coil may extend fully or partially around the circumference of the wick 28. In another embodiment, the heater coil is not in contact with the wick 28.

The heater 14 heats the pre-vapor formulation in the wick 28 by thermal conduction. Alternatively, heat from the heater 14 may be conducted to the pre-vapor formulation by means of a heat conductive element or the heater 14 may transfer heat to the incoming ambient air that is drawn through the non-combustible smoking device 60 during use, which in turn heats the pre-vapor formulation by convection.

In one embodiment, the wick comprises a ceramic material or ceramic fibers. As noted above, the wick 28 is at least partially surrounded by the heater 14. Moreover, in an embodiment, the wick 28 extends through opposed openings in the inner tube 62 such that end portions 29, 31 of the wick 28 are in contact with the pre-vapor formulation supply reservoir 22.

The wick 28 may comprise a plurality or bundle of filaments. In one embodiment, the filaments may be generally aligned in a direction transverse to the longitudinal direction of the non-combustible smoking device 60, but example embodiments are not limited to this orientation. In one embodiment, the structure of the wick 28 is formed of ceramic filaments capable of drawing the pre-vapor formulation via capillary action via interstitial spacing between the filaments to the heater 14. The wick 28 can include filaments having a cross-section which is generally cross-shaped, clover-shaped, Y-shaped or in any other suitable shape.

The wick 28 includes any suitable material or combination of materials. Examples of suitable materials are glass filaments and ceramic or graphite based materials. Moreover, the wick 28 may have any suitable capillarity to accommodate pre-vapor formulations having different physical properties such as density, viscosity, surface tension and vapor pressure. The capillary properties of the wick 28, combined with the properties of the pre-vapor formulation, ensure that the wick 28 is always wet in the area of the heater 14 to avoid overheating of the heater 14.

Instead of using a wick, the heater 14 can be a porous material of sufficient capillarity and which incorporates a resistance heater formed of a material having a high electrical resistance capable of generating heat quickly.

In other example embodiments, the heater 14 can be made of a sheet metal with two pieces bent into a semicircle and interlaced together. In other example embodiments, the heater 14 may be a serpentine heater placed inside the wick 28, a mesh heater, a flat plate heater, a Wismec Theorem heater with NotchCoil™, a spiral heater, a ceramic heating film, a curled heater and/or a platinum heater In one embodiment, the wick 28 and the pre-vapor formulation storage medium 21 of the pre-vapor formulation supply reservoir 22 are constructed from an alumina ceramic. In another embodiment, the wick 28 includes glass fibers and the pre-vapor formulation storage medium 21 includes a cellulosic material or polyethylene terephthalate.

In an embodiment, the power supply 1 may include a battery arranged in the non-combustible smoking device 60 such that the anode is downstream of the cathode. An anode connector 4 contacts the downstream end of the battery. The heater 14 is connected to the battery by two spaced apart electrical leads.

The connection between the uncoiled, end portions 27, 27' (see FIG. 4) of the heater 14 and the electrical leads are highly conductive and temperature resistant while the heater 14 is highly resistive so that heat generation occurs primarily along the heater 14 and not at the contacts.

The battery may be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, the non-combustible smoking device 60 is usable until the energy in the power supply is depleted. Alternatively, the power supply 1 may be rechargeable and include circuitry allowing the battery to be chargeable by an external charging device. In that case, the circuitry, when charged, provides power for a desired (or alternatively a pre-determined) number of applications of negative pressure, after which the circuitry must be re-connected to an external charging device.

The non-combustible smoking device 60 also includes control circuitry including the sensor 16. The sensor 16 is operable to sense an air pressure drop and initiate application of voltage from the power supply 1 to the heater 14. The control circuitry can also include a heater activation light 48 operable to glow when the heater 14 is activated. In one embodiment, the heater activation light 48 comprises a heater activation light (e.g., a light emitting diode (LED)) 48 and is at an upstream end of the non-combustible smoking device 60 so that the heater activation light 48 takes on the appearance of a burning coal during an application of a negative pressure. Moreover, the heater activation light 48 can be arranged to be visible to the adult tobacco consumer. In addition, the heater activation light 48 can be utilized for e-vaping system diagnostics. The light 48 can also be configured such that the adult tobacco consumer can activate and/or deactivate the light 48 for privacy, such that the light 48 would not activate during vaping if desired.

The at least one air inlet 44*a* is located adjacent the sensor 16, such that the sensor 16 senses air flow indicative of a negative pressure and activates the power supply 1 and the heater activation light 48 to indicate that the heater 14 is working.

A control circuit is integrated with the sensor 16 and supplies power to the heater 14 responsive to the sensor 16, for example, with a maximum, time-period limiter.

Alternatively, the control circuitry may include a manually operable switch for an application of a negative pressure. The time-period of the electric current supply to the heater 14 may be pre-set depending on the amount of pre-vapor formulation desired to be vaporized. The control circuitry may be programmable for this purpose. Alternatively, the circuitry may supply power to the heater as long as the sensor 16 detects a pressure drop.

When activated, the heater 14 heats a portion of the wick 28 surrounded by the heater for less than about 10 seconds, more preferably less than about 7 seconds. Thus, the power cycle can range in period from about 2 seconds to about 10 seconds (e.g., about 3 seconds to about 9 seconds, about 4 seconds to about 8 seconds or about 5 seconds to about 7 seconds).

In an embodiment, the pre-vapor formulation supply reservoir 22 includes the pre-vapor formulation storage medium 21 containing pre-vapor formulation material. In FIG. 1, the pre-vapor formulation supply reservoir 22 is contained in an outer annulus between inner tube 62 and outer tube 6 and between stopper 10 and the seal 15. Thus, the pre-vapor formulation supply reservoir 22 at least partially surrounds the central air passage 20 and the heater 14 and the wick 28 extend between portions of the pre-vapor formulation supply reservoir 22.

The pre-vapor formulation storage medium 21 may be a fibrous material comprising cotton, polyethylene, polyester, rayon and/or combinations thereof. The fibers may have a diameter ranging in size from about 6 microns to about 15 microns (e.g., about 8 microns to about 12 microns or about 9 microns to about 11 microns). The pre-vapor formulation storage medium 21 may be a sintered, porous or foamed material. Also, the fibers may be sized to be irrespirable and can have a cross-section which has a y shape, cross shape, clover shape or any other suitable shape.

In another example embodiment, the pre-vapor formulation storage medium 21 may be a tobacco filler or tobacco slurry.

Also, the pre-vapor formulation material has a boiling point suitable for use in the non-combustible smoking device 60. If the boiling point is too high, the heater 14 will not be able to vaporize the pre-vapor formulation in the wick 28. However, if the boiling point is too low, the pre-vapor formulation may vaporize without the heater 14 being activated.

A pre-vapor formulation is a material or combination of materials that may be transformed into a generated vapor. For example, the pre-vapor formulation may be a liquid, solid and/or gel formulation including, but not limited to, water, beads, solvents, active ingredients, ethanol, plant extracts, natural or artificial flavors, and/or vapor formers such as glycerine and propylene glycol.

The pre-vapor formulation may include a tobacco element including volatile tobacco flavor compounds which are released upon heating. When the tobacco element is in the pre-vapor formulation the physical integrity of the tobacco element is preserved. For example, the tobacco element may be 2-30% by weight in the pre-vapor formulation.

For example, the tobacco element may be in the form of a sheet or shreads and is added after the pre-vapor formulation is added to the pre-vapor formulation storage medium 21.

In operation, with non-combustible smoking device 60 in an assembled configuration, a negative pressure may be applied on the mouth-end insert 8. This negative pressure may cause an internal pressure drop inside non-combustible smoking device 60 that may cause an inlet air flow to enter device 60 via air inlets 44/44'. The internal pressure drop may also cause an internal pressure drop within section 72 as air is drawn through air inlet 44*a* (via an air flow path traveling through section 72). The internal pressure drop formed in section 72 may be sensed by sensor 16. The sensor 16 may then operate to close an electrical circuit that includes the power supply 1. In turn, electrical leads carry an electrical current to heater 14 in order to energize the heater 14. The energized heater 14 in turn heats and vaporizes the pre-vapor formulation material that is drawn toward the heater 14 via the wick 28.

Figure 3:
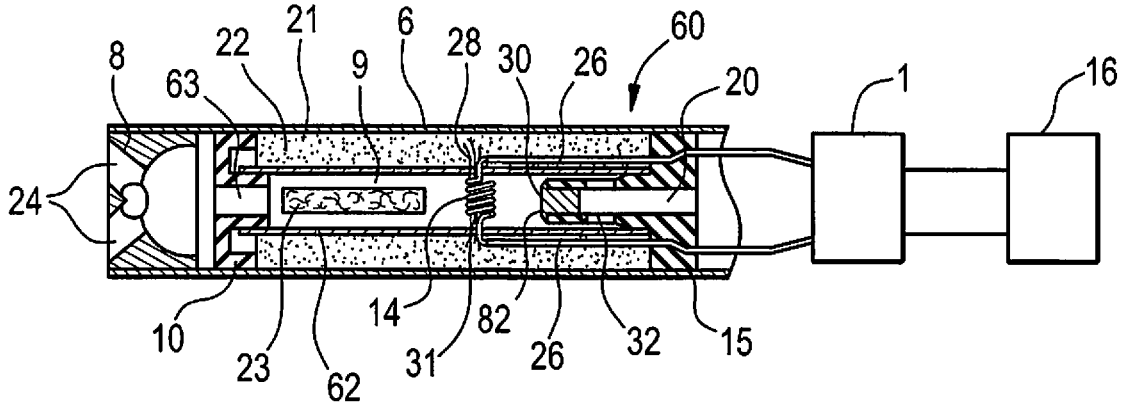
FIG. 3 is a cross-sectional view of an embodiment wherein a non-combustible smoking device includes an air flow diverter, in accordance with an example embodiment.

The pre-vapor formulation material is transferred from the pre-vapor formulation supply reservoir 22 and/or pre-vapor formulation storage medium 21 in proximity of the heater 14 by capillary action in the wick 28. In one embodiment, the wick 28 has a first end portion 29 and a second opposite end portion 31 as shown in FIG. 3. The first end portion 29 and the second end portion 31 extend into opposite sides of the pre-vapor formulation storage medium 21 for contact with pre-vapor formulation material contained therein. The heater 14 at least partially surrounds a central portion of the wick 28 such that when the heater 14 is activated, the pre-vapor formulation in the central portion of the wick 28 is vaporized by the heater 14 to vaporize the pre-vapor formulation material and form the generated vapor. Due to a negative pressure being applied, the generated vapor flows from the heater 14, through the tobacco element 23 (to generate a flavored vapor) and out of the mouth-end insert 8.

The generated vapor may elute tobacco elements into the flow stream. Some thermal reactions may also be present between the generated vapor and the tobacco element.

One advantage of an embodiment is that the pre-vapor formulation material in the pre-vapor formulation supply reservoir 22 is protected from oxygen (because oxygen cannot generally enter the pre-vapor formulation storage portion via the wick) so that the risk of degradation of the pre-vapor formulation material is significantly reduced. Moreover, in some embodiments in which the outer tube 6 is not clear, the pre-vapor formulation supply reservoir 22 is protected from light so that the risk of degradation of the pre-vapor formulation material is significantly reduced. Thus, a high level of shelf-life and cleanliness can be maintained.

As shown in FIGS. 2A and 2B, the mouth-end insert 8, includes at least two diverging outlets 24 (e.g., 3, 4, 5 or more). The outlets 24 of the mouth-end insert 8 are located at ends of off-axis passages 80 and are angled outwardly in relation to the longitudinal direction of the non-combustible smoking device 60 (i.e., divergently). As used herein, the term "off-axis" denotes at an angle to the longitudinal direction of the non-combustible smoking device 60. Also, the mouth-end insert (or flow guide) 8 may include outlets uniformly distributed around the mouth-end insert 8 so as to substantially uniformly distribute the flavored vapor during use. Thus, the flavored vapor moves in different directions as compared to e-vaping devices having an on-axis single orifice which directs the vapor to a single location.

In addition, the outlets 24 and off-axis passages 80 are arranged such that droplets of unvaporized pre-vapor formulation carried in the vapor impact interior surfaces 81 at mouth-end insert and/or interior surfaces of the off-axis passages such that the droplets are removed or broken apart. In an embodiment, the outlets of the mouth-end insert are located at the ends of the off-axis passages and are angled at 5 to 60 degrees with respect to the central axis of the outer tube 6 so as to more completely distribute flavored vapor during use and to remove droplets.

Preferably, each outlet has a diameter of about 0.015 inch to about 0.090 inch (e.g., about 0.020 inch to about 0.040 inch or about 0.028 inch to about 0.038 inch). The size of the outlets 24 and off-axis passages 80 along with the number of outlets can be selected to adjust the resistance to draw (RTD) of the non-combustible smoking device 60, if desired.

As shown in FIG. 1, an interior surface 81 of the mouth-end insert 8 can comprise a generally domed surface. Alternatively, as shown in FIG. 2B, the interior surface 81' of the mouth-end insert 8 can be generally cylindrical or frustoconical, with a planar end surface. The interior surface is substantially uniform over the surface thereof or symmetrical about the longitudinal axis of the mouth-end insert 8. However, in other embodiments, the interior surface can be irregular and/or have other shapes.

The mouth-end insert 8 is integrally affixed within the tube 6 of the section 70. Moreover, the mouth-end insert 8 may be formed of a polymer selected from the group consisting of low density polyethylene, high density polyethylene, polypropylene, polyvinylchloride, polyetheretherketone (PEEK) and combinations thereof. The mouth-end insert 8 may also be colored if desired.

In an embodiment, the non-combustible smoking device 60 also includes various embodiments of an air flow diverter or air flow diverter means. The air flow diverter is operable to manage air flow at or about around the heater so as to abate a tendency of drawn air to cool the heater, which could otherwise lead to diminished vapor output.

Figure 4:
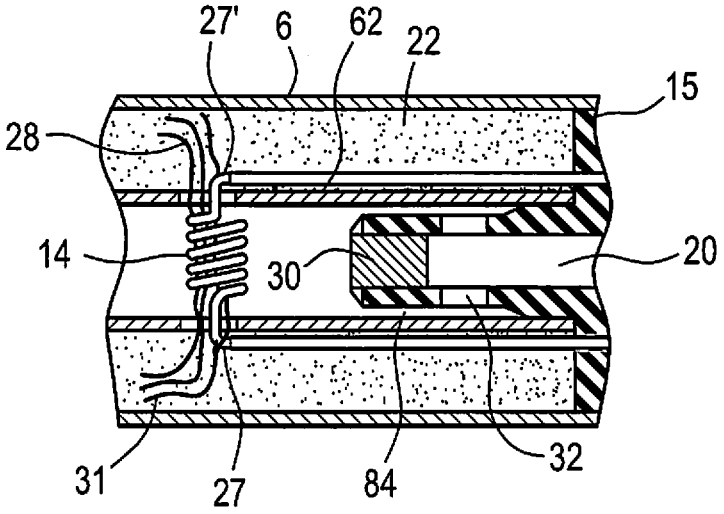
FIG. 4 is an enlarged view of the air flow diverter of the non-combustible smoking device of FIG. 3, in accordance with an example embodiment.

In one embodiment, as shown in FIGS. 3-4, the non-combustible smoking device 60 can include an air flow diverter comprising an impervious plug 30 at a downstream end 82 of the central air passage 20 in seal 15. The central air passage 20 is an axially extending central passage in seal 15 and inner tube 62. The seal 15 seals the upstream end of the annulus between the outer and inner tubes 6, 62. The air flow diverter may include at least one radial air channel 32 directing air from the central air passage 20 outward toward the inner tube 62 and into the outer air passage 9 defined between an outer periphery of a downstream end portion of the seal 15 and the inner wall of inner tube 62.

The diameter of the bore of the central air passage 20 is substantially the same as the diameter of the at least one radial air channel 32. Also, the diameter of the bore of the central air passage 20 and the at least one radial air channel 32 may range from about 1.5 mm to about 3.5 mm (e.g., about 2.0 mm to about 3.0 mm). Optionally, the diameter of the bore of the central air passage 20 and the at least one radial air channel 32 can be adjusted to control the resistance to draw of the non-combustible smoking device 60. In use, the air flows into the bore of the central air passage 20, through the at least one radial air channel 32 and into the outer air passage 9 such that a lesser portion of the air flow is directed at a central portion of the heater 14 so as to reduce or minimize the aforementioned cooling effect of the airflow on the heater 14 during heating cycles. Thus, incoming air is directed away from the center of the heater 14 and the air velocity past the heater is reduced as compared to when the air flows through a central opening in the seal 15 oriented directly in line with a middle portion of the heater 14.

Figure 5:
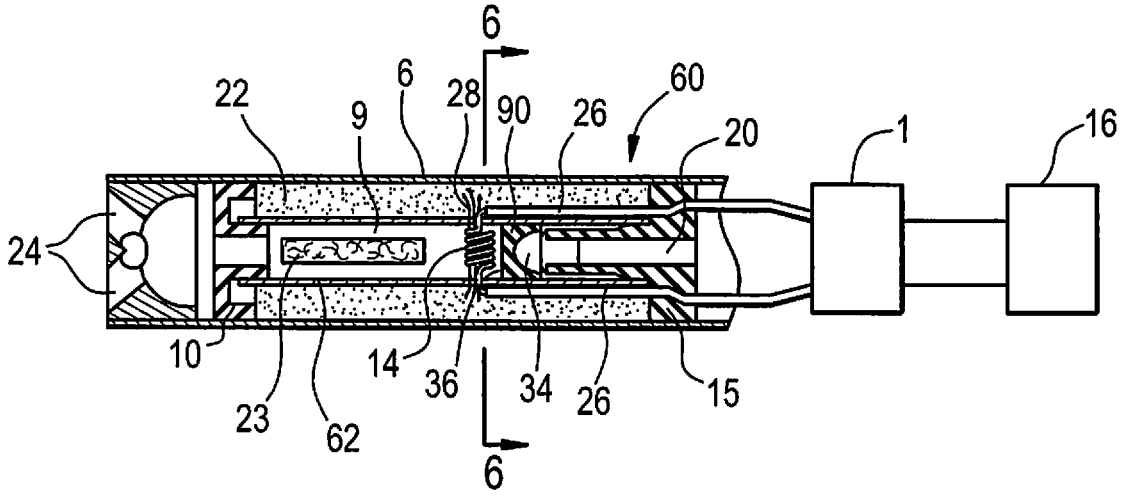
FIG. 5 is a cross-sectional view of an embodiment wherein a non-combustible smoking device includes an air flow diverter, in accordance with an example embodiment.
Figure 6:
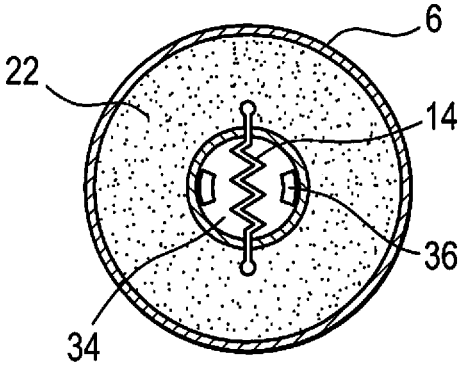
FIG. 6 is a cross-sectional view along line A-A of the non-combustible smoking device of FIG. 6, in accordance with an example embodiment.

In another embodiment, as shown in FIGS. 5-6, the air flow diverter can be in the form of a disc 34 positioned between the downstream end of seal 15 and the heater 14. The disc 34 includes at least one orifice 36 in a transverse wall at a downstream end of an outer tubular wall 90. The at least one orifice 36 may be off-axis so as to direct incoming air outward towards the inner wall of tube 62. During an application of a negative pressure, the disc 34 is operable to divert air flow away from a central portion of the heater 14 so as to counteract the tendency of the airflow to cool the heater as a result of a strong or prolonged draw by an adult tobacco consumer. Thus, the heater 14 is substantially reduced or prevented from cooling during heating cycles so as to reduce or prevent a drop in the amount of vapor produced during an application of a negative pressure.

Figure 7:
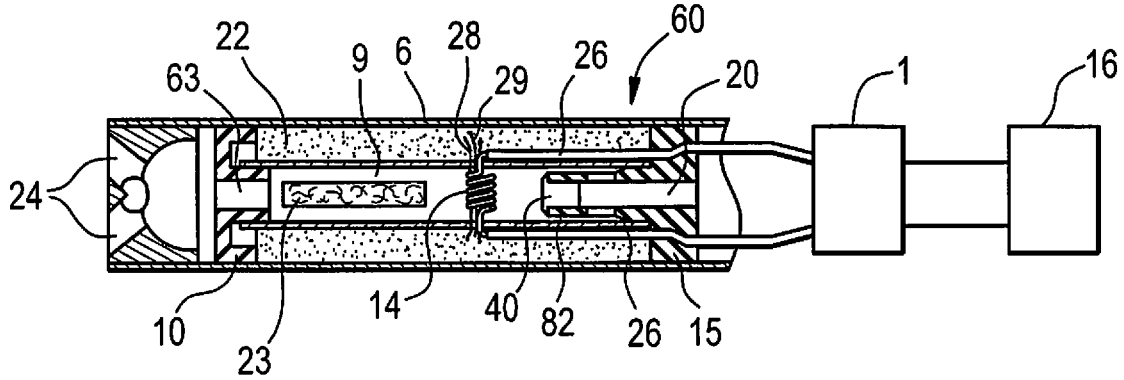
FIG. 7 is a cross-sectional view of an embodiment wherein a non-combustible smoking device includes an air flow diverter, in accordance with an example embodiment.

In yet another embodiment, as shown in FIG. 7, the air flow diverter comprises a frustoconical section 40 extending from the downstream end 82 of a shortened central air passage 20. By shortening the central air passage 20 as compared to other embodiments, the heater 14 is positioned farther away from the central air passage 20 allowing the air flow to decelerate before contacting the heater 14 and lessen the tendency of the air flow to cool the heater 14. Alternatively, the heater 14 can be moved closer to the mouth-end insert 8 and farther away from the central air passage 20 to allow the air flow time and/or space sufficient to decelerate to achieve the same cooling-abatement effect.

The addition of the frustoconical section 40 provides a larger diameter bore size which can decelerate the air flow so that the air velocity at or about the heater 14 is reduced so as to abate the cooling effect of the air on the heater 14 during negative pressure cycles. The diameter of the large (exit) end of the frustoconical section 40 ranges from about 2.0 mm to about 4.0 mm, and preferably about 2.5 mm to about 3.5 mm.

The diameter of the bore of the central air passage 20 and the diameter of the smaller and/or larger end of the frustoconical section 40 can be adjusted to control the resistance to draw of the non-combustible smoking device 60.

The air flow diverter of the various embodiments channels the air flow by controlling the air flow velocity (its speed and/or the direction of the air flow). For example, the air flow diverter can direct air flow in a particular direction and/or control the speed of the air flow. The air flow speed may be controlled by varying the cross sectional area of the air flow route. Air flow through a constricted section increases in speed while air flow through a wider section decreases speed.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. In one embodiment, the material is light and non-brittle.

Figure 8:
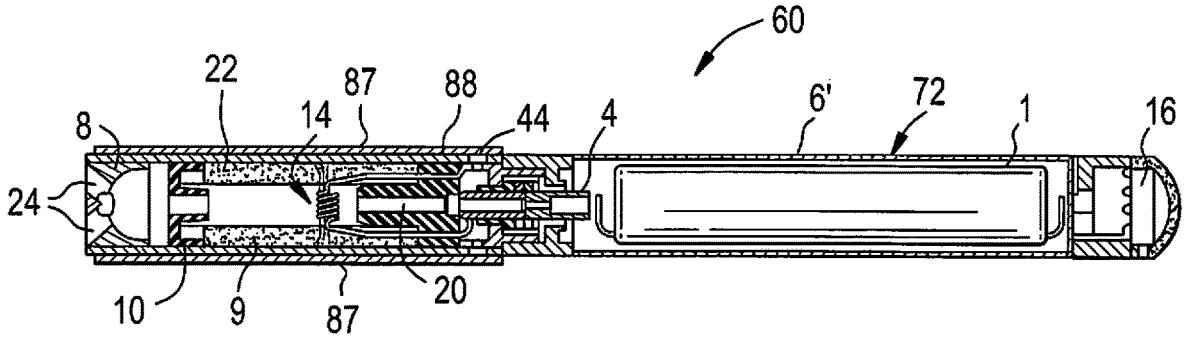
FIG. 8 is a cross-sectional view of a non-combustible smoking device and further including a sleeve assembly, in accordance with an example embodiment.

As shown in FIG. 8, the non-combustible smoking device 60 can also include a sleeve assembly 87 removably and/or rotatably positioned about the outer tube 6 adjacent the first section 70 of the non-combustible smoking device 60. Moreover, the sleeve assembly 87 insulates at least a portion of the first section 70 so as to maintain the temperature of the generated vapor prior to delivery to the adult tobacco consumer. In an embodiment, the sleeve assembly 87 is rotatable about the non-combustible smoking device 60 and includes spaced apart slots 88 arranged transversely about the sleeve assembly such that the slots 88 line up with the air inlets 44 in the first section 70 to allow air to pass into the non-combustible smoking device 60 when a negative pressure is applied on the non-combustible smoking device 60. Before or during vaping, the adult tobacco consumer can rotate the sleeve assembly 87 such that the air inlets 44 are at least partially blocked by the sleeve assembly 87 so as to adjust the resistance to draw and/or ventilation of the non-combustible smoking device 60.

The sleeve assembly 87 is made of silicone or other pliable material so as to provide a soft mouthfeel to the adult tobacco consumer. However, the sleeve assembly 87 may be formed in one or more pieces and can be formed of a variety of materials including plastics, metals and combinations thereof. In an embodiment, the sleeve assembly 87 is a single piece formed of silicone. The sleeve assembly 87 may be removed and reused with other non-combustible smoking devices or can be discarded along with the first section 70. The sleeve assembly 87 may be any suitable color and/or can include graphics or other indicia.

Figure 9:
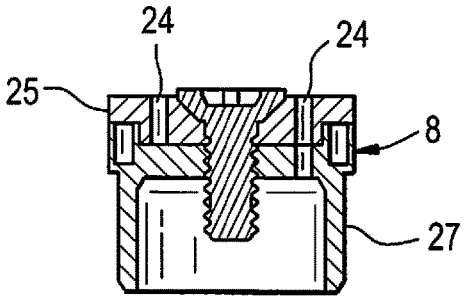
FIG. 9 is a cross-sectional view of a second embodiment of a mouth-end insert for use with a non-combustible smoking device, in accordance with an example embodiment.
Figure 10:
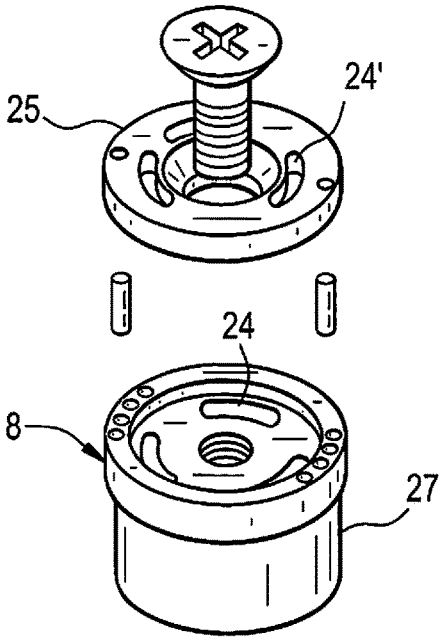
FIG. 10 is an exploded view of the mouth-end insert of FIG. 9, in accordance with an example embodiment.

As shown in FIGS. 9-10, in an alternative embodiment, the non-combustible smoking device can include a mouth-end insert 8 having a stationary piece 27 and a rotatable piece 25. Outlets 24, 24' are located in each of the stationary piece 27 and the rotatable piece 25. One or more of the outlets 24, 24' align as shown to allow flavored vapor to enter an adult tobacco consumer's mouth. However, the rotatable piece 25 can be rotated within the mouth-end insert 8 so as to at least partially block one or more of the outlets 24 in the stationary piece 27. Thus, the amount of flavored vapor output may be varied with each application of a negative pressure. The outlets 24, 24' can be formed in the mouth-end insert 8 such that the outlets 24, 24' diverge.

In another embodiment, the air flow diverter comprises the addition of a second wick element adjacent to but just upstream of the heater 14. The second wick element diverts portions of the air flow about the heater 14.

While FIGS. 1, 3, 5 and 7-8 illustrate a tobacco element in an outer air passage, example embodiments are not limited thereto.

Figure 11A:
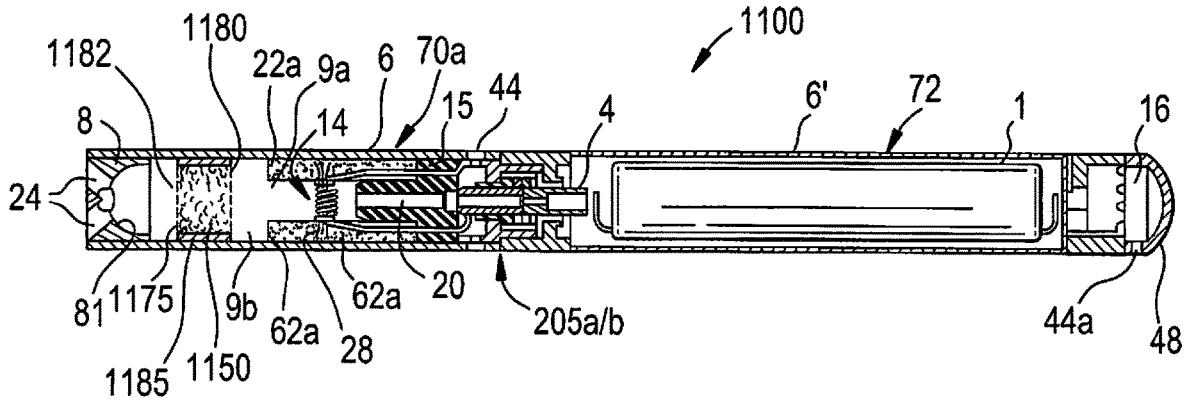
FIGS. 11A-11B illustrate example embodiments of a non-combustible smoking device including a tobacco element.

FIG. 11A illustrates an example embodiment of a non-combustible smoking device 1100 including a tobacco element 1150. The non-combustible smoking device 1100 is similar to the non-combustible smoking device 60. Thus, for the sake of brevity, only the differences will be described.

The non-combustible smoking device 1100 includes a pre-vapor formulation supply reservoir 22*a*. The pre-vapor formulation supply reservoir 22*a* is the same as the pre-vapor formulation supply reservoir 22 except the pre-vapor formulation supply reservoir 22*a* is shorter in the longitudinal direction.

A first section 70*a* includes the outer tube 6 (or housing) extending in a longitudinal direction and an inner tube 62*a* coaxially positioned within the outer tube or housing 6. The inner tube 62*a* defines a first outer air passage 9*a*. The first outer air passage 9*a* opens to a second outer air passage 9*b*.

An end of the inner tube 62*a* and the mouth-end insert 8 defines the second outer air passage 9*b*. In other words, the outer tube 6 may define a diameter in the latitudinal direction of the second outer air passage 9*b*. As shown, the diameter in the latitudinal direction of the second outer air passage 9*b* is larger than a diameter in the latitudinal direction of the first outer air passage 9*a*.

Within the second outer air passage 9*b* is the tobacco element 1150. The tobacco element 1150 may be inserted into the second outer air passage 9*b* by removing the mouth-end insert 8 and inserting the tobacco element 1150 into the second outer air passage 9*b*, for example.

The tobacco element 1150 may be a tobacco plug which refers to a compressed form of tobacco including, but not limited to tobacco strands, rolled tobacco or filler. The tobacco plug may be wrapped in natural tobacco, reconstituted sheet tobacco or aluminum, for example. While only one tobacco plug is illustrated, it should be understood that a plurality of tobacco plugs may be used. Fibrous segments (e.g., cellulose acetate, other synthetic fibers, or natural fibers) may be placed between the plurality of tobacco plugs.

For example, a cylindrical housing 1185 holds tobacco. The cylindrical housing 1185 may be made of aluminum, for example. The cylindrical housing 1185 has an outer diameter that fits with the diameter of the outer air passage 9*b*. Along the longitudinal axis of the housing 6, mesh screens 1175 and 1180 fit at ends of the cylindrical housing 1185 to enclose the tobacco in the cylindrical housing 1185. As shown in FIG. 11A, the mesh screens 1175 and 1180 include openings 1182 to allow air to pass from one end of the cylindrical housing through the tobacco and out of the end of the cylindrical housing 1185 closest to the mouth-end insert 8.

The tobacco element 1150 is arranged in such a way to allow the generated vapor generated by the heater 14 to pass through the tobacco. For example, the tobacco element 1150 may be spaced a first distance from the mouth-end insert 8 and a second distance from the pre-vapor formulation supply reservoir 22. The first distance and the second distance may be the same or different.

Due to a negative pressure being applied, the generated vapor flows from the heater 14, through the tobacco element 1150 and out of the mouth-end insert 8. The heater 14 may be a set distance from the tobacco element 1150 or contacting the tobacco element 1150 such that the heater 14 heats the tobacco to a temperature (as described above) during an application of a negative pressure. In an example, the heater 14 may be 1-5 mm from the tobacco element 1150.

Figure 11B:
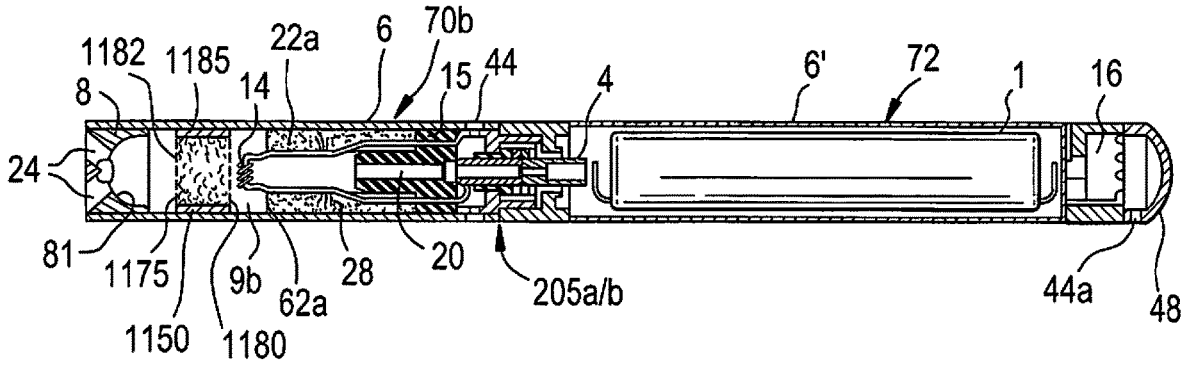

While the inner tube 62*a* is shown as extending past the heater 14 in the longitudinal direction to the mouth-end insert 8, it should be understood that the heater 14 may be arranged to extend into the second outer air passage 9*b*. As a result, the tobacco element 1150 may be spaced apart from the heater 14 or in contact with the heater 14, such as shown FIG. 11B. In FIG. 11B, the heater 14 is in the second outer passage 9*b* of a section 70*b*. Thus, pre-vapor formulation supply reservoir 11*a*, the heater 14 and the tobacco element 1150 are sequentially arranged.

While the gasket 10 is not illustrated, the non-combustible smoking device 11 may include the gasket 10.

Figure 12:
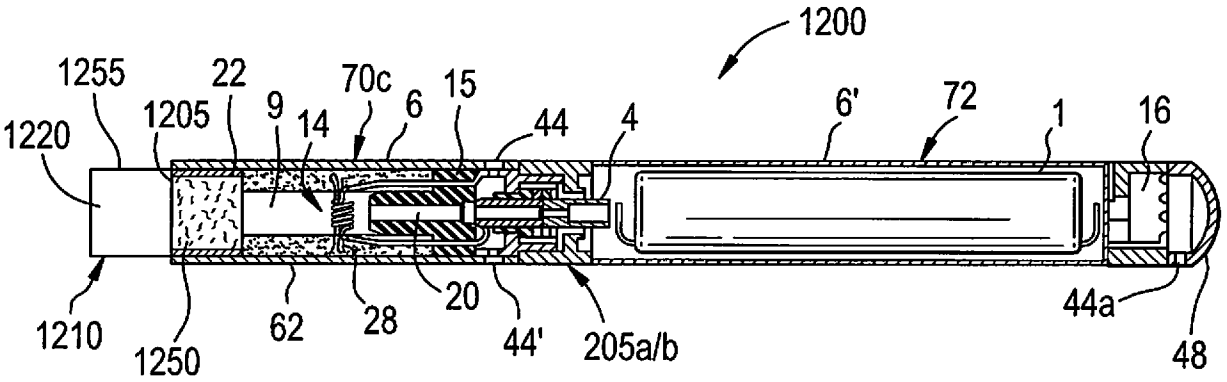
FIG. 12 illustrates an example embodiment of a non-combustible smoking device.

FIG. 12 illustrates an example embodiment of a non-combustible smoking device 1200. FIG. 12 illustrates an example embodiment of a non-combustible smoking device 1200 including a tobacco element 1250. The non-combustible smoking device 1200 is similar to the non-combustible smoking device 60 except a section 70*c* does not include the mouth-end insert 8, the tobacco element 23 and the gasket 10 and the non-combustible smoking device 1200 further includes an insert 1210. Thus, for the sake of brevity, only the differences will be described.

By removing the mouth-end insert 8 and the gasket 10, the non-combustible smoking device 1200 includes a receiving area 1205 fitted to receive a tobacco insert 1210. The receiving area 1205 is defined by the outer tube 6 and an end of the pre-vapor formulation supply reservoir 22.

The tobacco insert 1210 may be a cigarette or cigar. For example, the tobacco insert may be a filtered cigarette, a non-filtered cigarette, a cigarillo, a filter tipped cigar filter, a tipped cigar or an untipped cigar/cigarillo, for example. However, example embodiments are not limited thereto.

The tobacco insert 1210 is a detachable insert. In the example shown in FIG. 12, the tobacco insert 1210 may be a cigarette or a portion of a cigarette. The tobacco insert 1210 includes a filter 1220 and a tobacco element 1250. In example embodiments where the tobacco insert is an untipped cigar/cigarillo, the tobacco insert does not include a filter.

Tipping paper 1255 may overlap the filter 1220 and the tobacco element 1250. The tipping paper 1255 may cover surface areas of the tobacco insert 1210 that extend in along the outer tube 6. Thus, the tipping paper 1255 provides stiffness to the tobacco insert 1210, permitting easier insertion to the receiving area 1205. An aluminum foil may also be used to contain the tobacco element 1250, with or without additional tipping paper.

The position of the heater 14 is not limited to the position shown in FIG. 12. For example, the heater 14 may be positioned at the end of the outer air passage 9 such that the heater 14 is closer to the tobacco element 1250 and/or in contact with the tobacco element 1250. In another example embodiment, the heater 14 may protrude out of the outer air passage 9 in the same manner as shown in FIG. 11B.

The heater 14 may be a set distance from the tobacco element 1250 or contacting the tobacco element 1250 such that the heater 14 heats the tobacco element 1250 to a temperature (as described above) during an application of a negative pressure.

In operation, with non-combustible smoking device 1200 in an assembled configuration, a negative pressure may be applied on the tobacco insert 1210. The negative pressure may cause an internal pressure drop inside non-combustible smoking device 1200 that may cause an inlet air flow to enter the device 1200 via air inlets 44/44'. The internal pressure drop may also cause an internal pressure drop within section 72 as air is drawn through air inlet 44*a* (via an air flow path traveling through section 72). The internal pressure drop formed in section 72 may be sensed by sensor 16. The sensor 16 may then operate to close an electrical circuit that includes the power supply 1. In turn, electrical leads carry an electrical current to heater 14 in order to energize the heater 14. The energized heater 14 in turn heats and vaporizes a portion of the pre-vapor formulation that is drawn toward the heater 14 via the wick 28.

Pre-vapor formulation material is transferred from the pre-vapor formulation supply reservoir 22 and/or pre-vapor formulation storage medium 21 in proximity of the heater 14 by capillary action in the wick 28. When the heater 14 is activated, the pre-vapor formulation in the central portion of the wick 28 is vaporized by the heater 14 to vaporize the pre-vapor formulation material and form a generated vapor. Due to a negative pressure being applied, the generated vapor flows from the heater 14, through the tobacco element 1250 (to form a tobacco flavored vapor) and out of the filter 1220.

In the example shown in FIG. 12, the filter 1220 may be a cellulose acetate (CA) filter. CA filter elements, such as triacetin, can be eluted into the generated vapor. Vapor phase nicotine and other volatile elements in generated vapor can be reduced by a presence of tobacco.

Figure 13A:
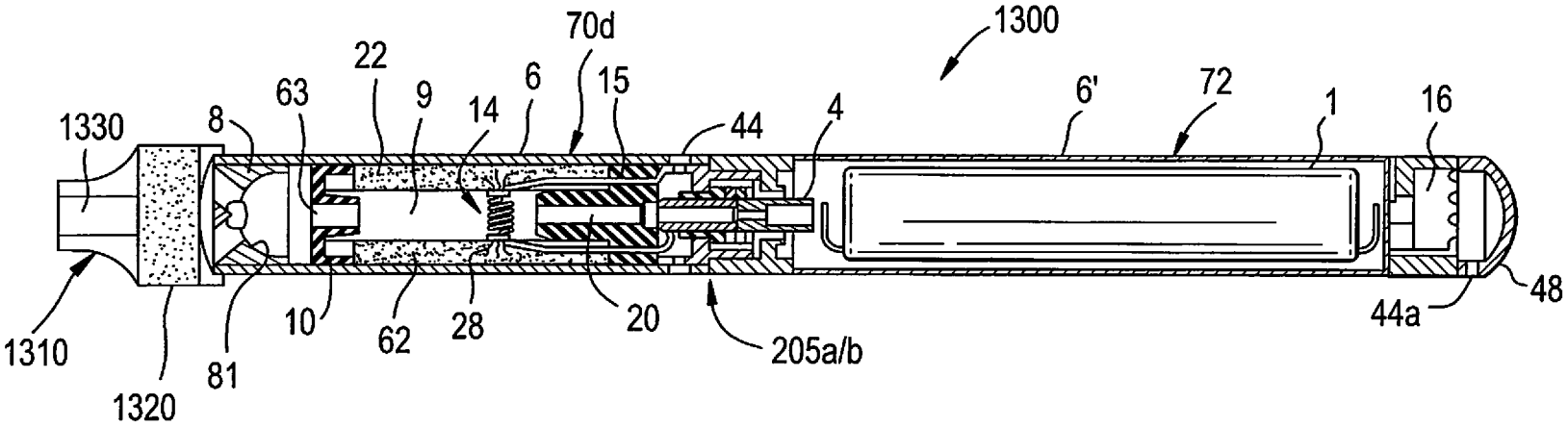
FIGS. 13A-13B illustrate example embodiments of a non-combustible smoking device including a tobacco element.

FIG. 13A illustrates an example embodiment of a non-combustible smoking device 1300.

The non-combustible smoking device 1300 is similar to the non-combustible smoking device 60 except a section 70*d* does not include the tobacco element 23 and the non-combustible smoking device 1300 further includes a detachable mouthpiece 1310. Thus, for the sake of brevity, only the differences will be described.

The detachable mouthpiece 1310 includes a tobacco element 1320. The tobacco element 1320 may be contained in a plug or bag, and attached to the inside of mouthpiece 1310. The detachable mouthpiece 1310 fits over a portion the outer tube 6 to form a seal between the detachable mouthpiece and the section 70*d*. The detachable mouthpiece 1310 may form the seal by sliding onto the outer tube 6 or having a connection mechanism (e.g., male/female) to connect to the outer tube 6.

In operation, with non-combustible smoking device 1300 in an assembled configuration, a negative pressure may be applied on the detachable mouthpiece 1310. Due to a negative pressure being applied, the generated vapor flows from the heater 14, through the mouth-end insert 8, into the tobacco element 1320 and out of the detachable mouthpiece 1310 through an air passage 1330.

The heater 14 may be a set distance from the tobacco element 1320 or contacting the tobacco element 1320 such that the heater 14 heats the tobacco element 1320 to a temperature (as described above) during an application of a negative pressure.

Figure 13B:
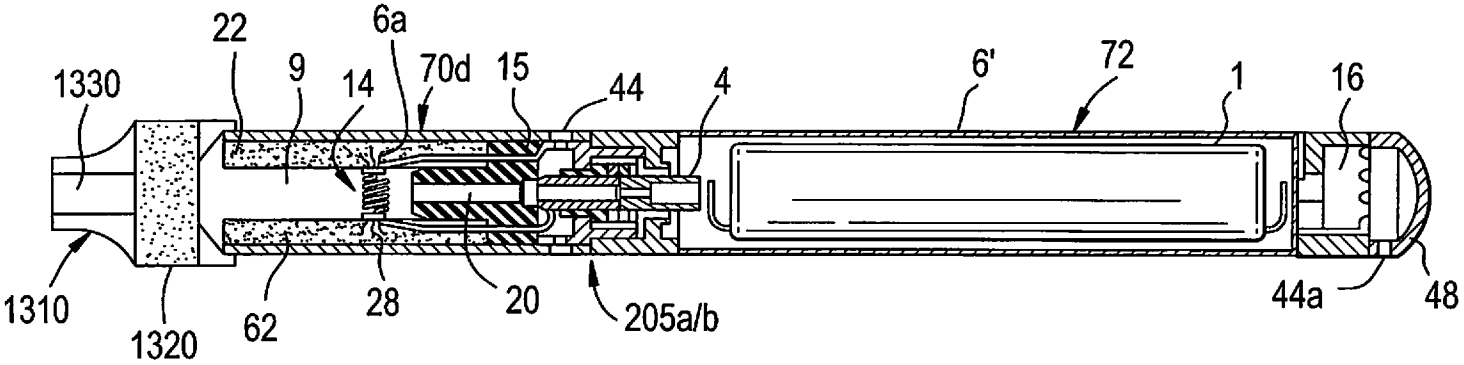

In another example embodiment, the mouth-end insert 8 and the gasket 10 may be omitted such as shown in FIG. 13B. In the embodiment shown in FIG. 13B, a tube 6*a* is shorter than the tube 6, of FIG. 13A.

In other example embodiments, the tobacco element may be in the pre-vapor formulation supply reservoir and/or function as the pre-vapor formulation storage medium.

Figure 14B:
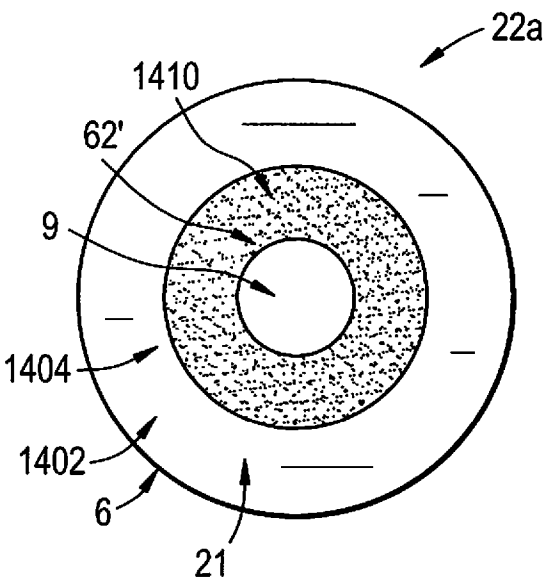
FIGS. 14A-B illustrate an example embodiment of a pre-vapor formulation supply reservoir.
Figure 14A:
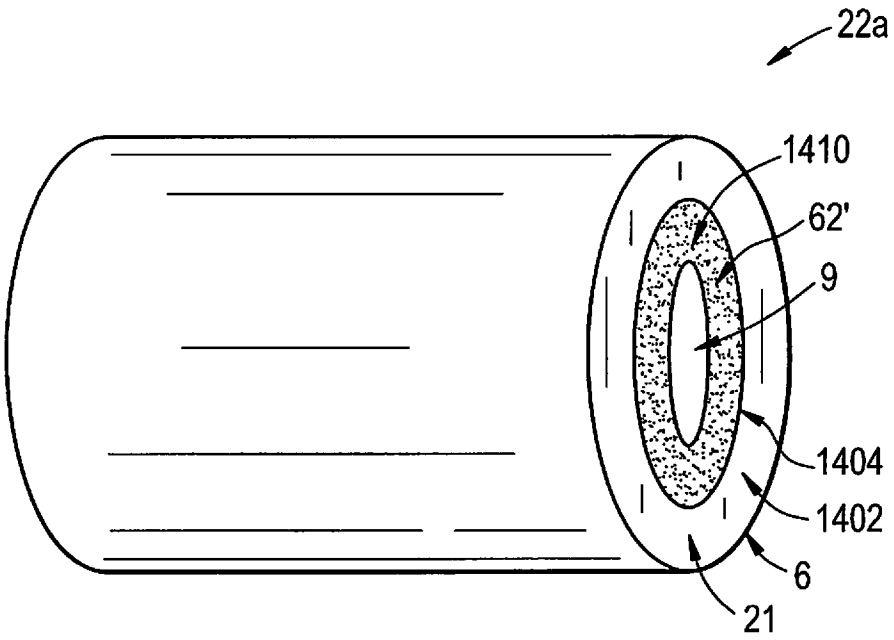

For example, FIGS. 14A-B illustrate an example embodiment of a pre-vapor formulation supply reservoir. A pre-vapor formulation supply reservoir 22*a* may be used as the pre-vapor formulation supply reservoir 22.

As shown, the pre-vapor formulation supply reservoir 22*a* includes a pre-vapor formulation 1402, an intermediate tube 1404, a tobacco element 1410 and an inner tube 62'. The inner tube 62' defines the air passage 9 and may include a metal grid, screen or mesh, for example.

In another example embodiment, the inner tube 62' may be the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene.

The intermediate tube 1404 may include a glass fiber. The pre-vapor formulation 1402 is between the intermediate tube 1404 and the outer tube 6 and may be in the pre-vapor formulation storage medium 21.

The tobacco element 1410 is between the inner tube 62' and the intermediate tube 1404. The tobacco element 1410 may be tobacco sheet, shreds, powder, beads or a sponge, for example. The inner tube 62' may include extenders protruding into the tobacco to help heat transfer.

In operation, a negative pressure may be applied to the non-combustible smoking device, which activates the heater 14, as described above. The heater heats the pre-vapor formulation 1402 to form a generated vapor and the generated vapor flows from the heater 14, through the tobacco element 1410 (to form a tobacco flavored vapor) and into the air passage 9.

As a result, the tobacco element 1410 is exposed to heat from the generated vapor and from the heater 14. Therefore, a tobacco aroma is imparted on the generated vapor.

In an example embodiment, an amount of tobacco element (e.g., filler) in the non-combustible smoking device may produce about a same number of applications of a negative pressure as a cigarette. Alternatively, the amount of tobacco element may produce a fixed number of applications of a negative pressure.

In an example embodiment, the tobacco element may have nicotine removed.

Example embodiments described in FIGS. 1-14B may be combined to utilize a tobacco element in more than one location. For example, a first tobacco element can be combined with the pre-vapor formulation in the pre-vapor formulation supply reservoir and a second tobacco element may be in the passage 9. In other example embodiment, a first tobacco element can be combined with the pre-vapor formulation in the pre-vapor formulation supply reservoir and a second tobacco element may be a tobacco plug in the second outer air passage 9*b*. In another example embodiment, a first tobacco element can be combined with the pre-vapor formulation in the pre-vapor formulation supply reservoir and a second tobacco element may be in an insert or detachable mouthpiece. In another example embodiment, a first tobacco element can be in the passage 9 and a second tobacco element may be in an insert or detachable mouthpiece.

Example embodiments provide a non-combustible smoking device having a heater that heats a pre-vapor formulation and may provide heat to a tobacco element. More specifically, the non-combustible smoke device according to example embodiments exposes a generated vapor to a tobacco element and/or exposes a pre-vapor formulation to a tobacco element. When the tobacco element is in the pre-vapor formulation the physical integrity of the tobacco element is preserved.

In other example embodiments, a non-combustible smoke device can be a pod device or tank device that exposes a generated vapor to a tobacco element and/or exposes a pre-vapor formulation to a tobacco element.

While a single heater is described with reference to FIGS. 1-14B, example embodiments may include a multiple heater non-combustible smoking device. A first heater may be the heater 14 to vaporize the pre-vapor formulation and a second heater may be used to heat the tobacco element. The second heater may penetrate the tobacco element.

Figure 15A:
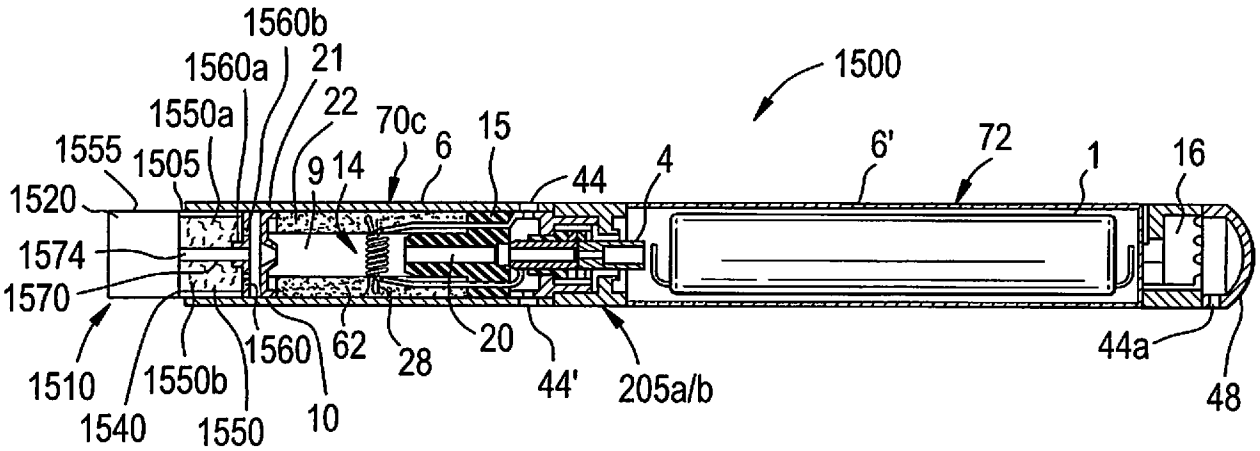
FIGS. 15A-15E illustrate an example embodiment of a non-combustible smoking device including a tobacco housing for tobacco and an airflow element in the tobacco housing.
Figure 15B:
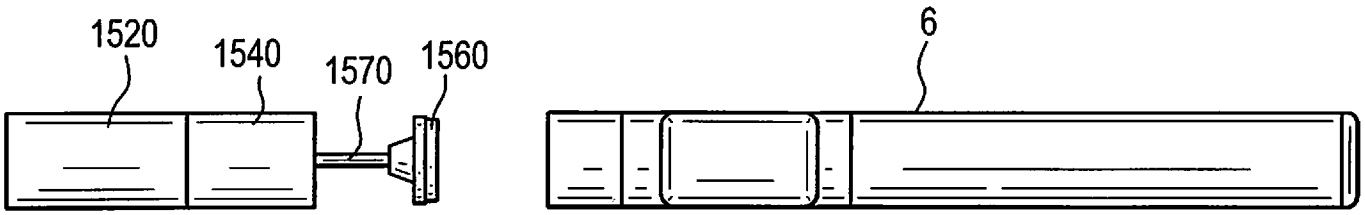
Figure 15C:
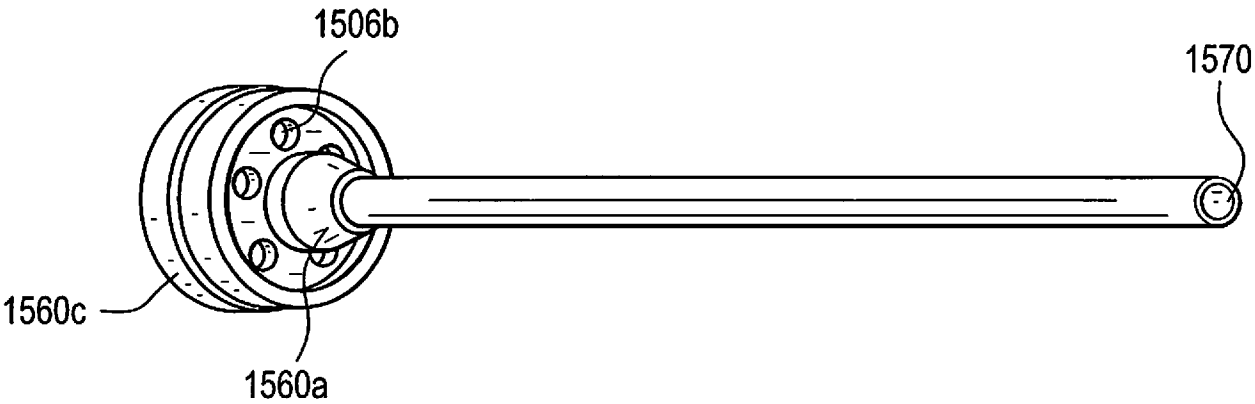

FIGS. 15A-15C illustrates an example embodiment of a non-combustible smoking device 1500. FIG. 15B illustrates a semi-exploded view of the non-combustible smoking device 1500. FIG. 15C illustrates a plan view of a gasket 1560 and an air flow element 1570.

FIG. 15A illustrates an example embodiment of a non-combustible smoking device 1500 including a tobacco housing 1540 containing a tobacco element 1550. The non-combustible smoking device 1500 is similar to the non-combustible smoking device 60 except a section 70*c* does not include the mouth-end insert 8 and the tobacco element 23 and the non-combustible smoking device 1500 further includes an insert 1510. Thus, for the sake of brevity, only the differences will be described.

The non-combustible smoking device 1500 includes a receiving area 1505 fitted to receive the insert 1510. The receiving area 1505 is defined by the outer tube 6 and the gasket 10.

The tobacco insert 1510 may be a cigarette or cigar containing the gasket 1560 and the air flow element 1570. For example, the tobacco insert 1510 may be a filtered cigarette, a non-filtered cigarette, a cigarillo, a filter tipped cigar filter, a tipped cigar or an untipped cigar/cigarillo, for example. However, example embodiments are not limited thereto.

The tobacco insert 1510 is a detachable insert.

The tobacco insert 1510 includes a filter 1520, the tobacco housing 1540, the gasket 1560 and the air flow element 1570. While only the gasket 1560 is illustrated in FIG. 15A, it should be understood that additional gaskets may be present. For example, for a longer air flow element, a second gasket may be used between the tobacco housing 1540 and the filter 1520 in order to stabilize the tubing. In an example, the tobacco housing 1540 may be 15-25 mm long in the longitudinal direction and 8 mm wide.

The gasket 1560 is between the gasket 10 and the tobacco element 1550. The gasket 1560 prevents the tobacco element 1550 from spilling into the channel 9 and holds the air flow element 1570.

The gasket 1560 includes a cylindrical receiving portion 1560*a* and holes 1560*b*. The holes 1560*b* connect the channel 9 to the tobacco element 1550, thus allowing generated vapor to flow from the channel 9 into the tobacco element 1550 and then into the filter 1520. The air flow element 1570 is attached to the gasket 1560 by inserting the air flow element 1570 into the cylindrical receiving portion 1560*a*. The air flow element 1570 and the cylindrical receiving portion 1560*a* may be connected using a ferrule. For example, a ferrule with a specific identification is used with an air flow element 1570 that corresponds to the specific identification. The ferrule is then incorporated into the gasket 1560. As an alternative, the air flow element 1570 is glued to the receiving portion 1560*a*.

FIG. 15C illustrates the arrangement of the gasket 1560 and the air flow element 1570 in more detail. As shown, the receiving portion 1560*a* protrudes from a base portion 1560*c* of the gasket 1560. The base portion 1560*c* is circular shaped. The holes 1560*b* extend through the base portion 1560*c* from a first exposed surface to a second exposed surface in the longitudinal direction of the receiving portion 1560*a*.

Referring back to FIG. 15A, the air flow element 1570 extends in the longitudinal direction of the device 1500 through the tobacco housing 1540. In other words, the air flow element 1570 provides an air passage from the channel 9 to the filter 1520. The air flow element 1570 may be a capillary tube made of at least one of PEEK and stainless steel.

The air flow element 1570 extends in the longitudinal direction from a first end portion of the tobacco housing 1540 to an opposing second end portion of the tobacco housing 1540. The air flow element 1570 includes a cylindrical surface 1572 that extends from a portion of the gasket 1560 closest to the reservoir to the filter 1520. A channel 1574 is defined by an inner surface area of the air flow element 1570, which is an inner diameter (ID) of the air flow element 1570 extending from a portion of the gasket 1560 closest to the reservoir to the filter 1520. The air flow element 1570 allows a desired amount of generated vapor (e.g., 20%) to flow through the housing 1540 without passing through the tobacco element 1550. The remaining amount of generated vapor (e.g., 80%) passes through the tobacco element 1550. The air flow element 1570 prevents the desired amount of generated vapor not exposed to the tobacco element 1550 from reacting with the tobacco element 1550. In an example embodiment, the desired amount of generated vapor to flow through the housing 1540 without passing through the tobacco element 1550 is 65%.

The size of the air flow element 1570 (e.g., inner volume) is based on the desired amount of generated vapor to flow through the channel 1574. In an example embodiment, the air flow element 1570 has an inner diameter of 0.5 mm to 3 mm and an outer diameter of 0.5-1.5 mm. In another example embodiment, the air flow element 1570 has an inner diameter of 2 mm to 2.5 mm. In an example embodiment, the air flow element 1570 has an outer diameter of 1.59 mm and an inner diameter of 1.02 mm. The air flow element 1570 may be 15-25 mm in length, but could be longer or shorter based on the length of housing 6. The air flow element 1570 may have a constant inner diameter or a varying inner diameter.

In the embodiment shown in FIG. 15A, the air flow element 1570 divides the tobacco element 1550 into two equal halves 1550*a* and 1550*b*. However, the air flow element 1570 may be placed in any location that allows generated vapor to flow through the housing 1540 without passing through the tobacco element 1550. In addition, multiple air flow elements may be used instead of one to generate a desired amount of generated vapor not exposed to the tobacco element 1550. The air flow element 1570 can be straight, spirally or curved towards the filter 1520.

To avoid condensation, the air flow element 1570 may be heated. When heated, the air flow element 1570 also provides heat to the tobacco element 1550. For example, the air flow element 1570 and the gasket 1560 may be made of a conductive material (e.g., stainless steel). The gasket 1560 is connected to the heater 14 to conduct heat to the air flow element 1570. The gasket 1560 may be connected to the heater 14 by a wire along the housing 6 from the heater 14 to the gasket 1560.

Tipping paper 1555 may overlap the filter 1520 and the tobacco housing 1540. The tipping paper 1555 may cover surface areas of the tobacco insert 1510 that extend in along the outer tube 6. Thus, the tipping paper 1555 provides stiffness to the tobacco insert 1510, permitting easier insertion to the receiving area 1505. An aluminum foil may also be used to contain the tobacco element 1550, with or without additional tipping paper.

The position of the heater 14 is not limited to the position shown in FIG. 15A. For example, the heater 14 may be positioned at the end of the outer air passage 9 such that the heater 14 is closer to the tobacco element 1550 and/or in contact with the tobacco element 1550. In another example embodiment, the heater 14 may protrude out of the outer air passage 9.

In operation, with non-combustible smoking device 1500 in an assembled configuration, a negative pressure may be applied on the tobacco insert 1510. The negative pressure may cause an internal pressure drop inside non-combustible smoking device 1500 that may cause an inlet air flow to enter the device 1500 via air inlets 44/44'. The internal pressure drop may also cause an internal pressure drop within section 72 as air is drawn through air inlet 44*a* (via an air flow path traveling through section 72). The internal pressure drop formed in section 72 may be sensed by sensor 16. The sensor 16 may then operate to close an electrical circuit that includes the power supply 1. In turn, electrical leads carry an electrical current to heater 14 in order to energize the heater 14. The energized heater 14 in turn heats and vaporizes a portion of the pre-vapor formulation that is drawn toward the heater 14 via the wick 28.

Pre-vapor formulation material is transferred from the pre-vapor formulation supply reservoir 22 and/or pre-vapor formulation storage medium 21 in proximity of the heater 14 by capillary action in the wick 28. When the heater 14 is activated, the pre-vapor formulation in the central portion of the wick 28 is vaporized by the heater 14 to vaporize the pre-vapor formulation material and form generated vapor. Due to a negative pressure being applied, the generated vapor flows from the heater 14, through the tobacco element 1550 and the channel 1574 and out of the filter 1520.

In the example shown in FIG. 15A, the filter 1520 may be a cellulose acetate (CA) filter. CA filter elements, such as triacetin, can be eluted into generated vapor. Vapor phase nicotine and other volatile elements in generated vapor can be reduced by a presence of tobacco.

Figure 15D:
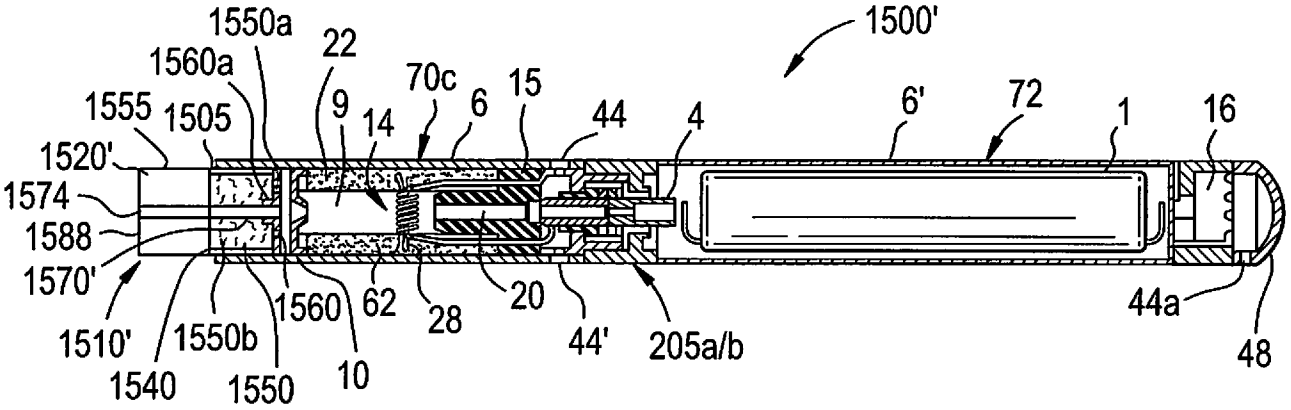

FIG. 15D illustrates another example embodiment of a non-combustible smoking device including a tobacco housing for tobacco and an airflow element in the tobacco housing.

As shown in FIG. 15D, a non-combustible smoking device 1500' is similar to the non-combustible smoking device 1500. Therefore, only the differences will be described.

The non-combustible smoking device 1500' includes a tobacco insert 1510' including an air-flow element 1570'. The air-flow element 1570' extends in the longitudinal direction from the first end portion of the tobacco housing 1540 to an end 1588 of the tobacco insert 1510'. A channel 1574' is defined by an inner surface area of the air flow element 1570', which is an inner diameter of the air flow element 1570' extending from a portion of the gasket 1560 closest to the reservoir to the filter 1520. As shown in FIG. 15D, the channel 1574' is exposed. Thus, the air-flow element 1570' creates an air path from the channel 9 to out of the non-combustible smoking device 1500' without the generated vapor being exposed to a filter 1520' and the tobacco element 1550.

Figure 15E:
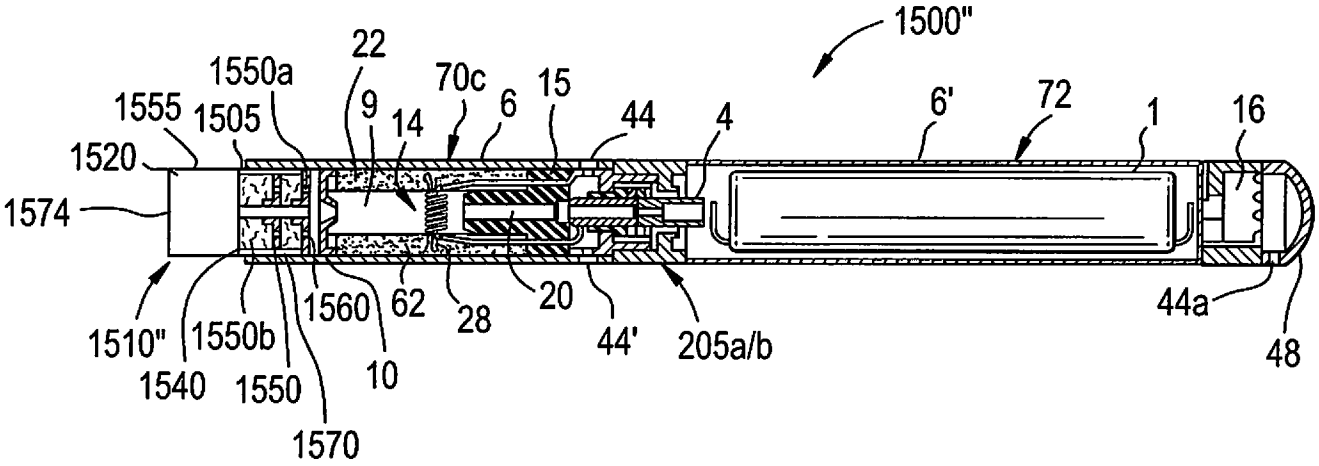

FIG. 15E illustrates another example embodiment of a non-combustible smoking device including a tobacco housing for tobacco and an airflow element in the tobacco housing.

As shown in FIG. 15E, a non-combustible smoking device 1500" is the same as the non-combustible smoking device 1500 except the tobacco insert 1510" includes a second gasket 1590. The second gasket 1590 may be the same as the gasket 1560, but is not limited thereto. The gasket 1590 is in the middle of the tobacco housing 1540 (e.g., 40-60% from either end of the tobacco housing 1540). The gasket 1590 provides additional stability to the air flow element 1570. Moreover, while an extra gasket is illustrated in an embodiment where the air-flow element 1570 does not extend through the filter 1520, it should be understood that a second gasket may be omitted in the tobacco insert 1510", as shown in FIG. 15D.

While example embodiments in FIGS. 15A-15E illustrate a gasket 1560, it should be understood that the tobacco insert may not have the gasket 1560. When no gasket 1560 exists, the air flow element 1570 may be connected to the gasket 10.

Figure 16A:
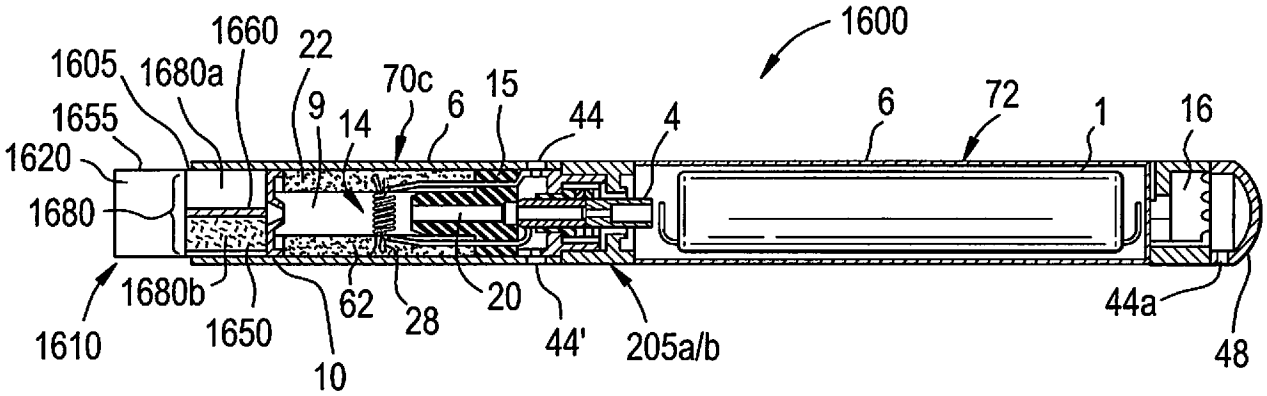
FIG. 16A illustrates an example embodiment of a non-combustible smoking device including a divider in a channel.

FIG. 16A illustrates an example embodiment of a non-combustible smoking device including a divider in a channel.

FIG. 16A illustrates an example embodiment of a non-combustible smoking device 1600 including a tobacco element 1650 and a divider 1660. The non-combustible smoking device 1600 is similar to the non-combustible smoking device 60 except a section 70*c* does not include the mouth-end insert 8 and the tobacco element 23 and the non-combustible smoking device 1600 further includes an insert 1610. Thus, for the sake of brevity, only the differences will be described.

By removing the mouth-end insert 8, the non-combustible smoking device 1600 includes a receiving area 1605 fitted to receive a tobacco insert 1610. The receiving area 1605 is defined by the outer tube 6 and the gasket 10.

The tobacco insert 1610 is a detachable insert. In the example shown in FIG. 16A, the tobacco insert 1610 may be a cigarette or a portion of a cigarette. The tobacco insert 1610 includes a filter 1620 and the tobacco element 1650. In example embodiments where the tobacco insert 1610 is an untipped cigar/cigarillo, the tobacco insert 1610 does not include a filter.

The divider 1660 is attached to an outer wall (e.g., tipping paper) 1655 of the tobacco insert 1610. The divider 1660 may be glued to the outer wall 1655. After the divider 1660 is attached to the outer wall 1655, the tobacco 1650 may be inserted into the insert 1610.

The divider 1660 may be a stainless steel wall extending in a longitudinal direction of the device 1600 and divides a channel 1680 between the air channel 9 and the filter 1620 in the longitudinal direction into an air channel 1680*a* and a tobacco channel 1680*b*. The air channel 1680*a* and the tobacco channel 1680*b* are defined by the gasket 10, the housing 6, the divider 1660 and the filter 1620. The channel 1680 may be considered a second portion of the channel 9 since generated vapor flows from the channel 9 through the gasket 1670 into the channel 1680.

The divider 1660 separates a portion of the tobacco insert 1610 a two compartment air channel 1680, where the tobacco channel 1680*b* includes the tobacco element 1650 and the air channel 1680*a* which does not include tobacco. The position of the divider 1660 allows a desired amount of generated vapor (e.g., 20%) to flow through the channel 1680 without passing through the tobacco element 1650. The remaining amount of generated vapor (e.g., 80%) passes through the tobacco element 1650. The divider 1650 prevents the desired amount of generated vapor not exposed to the tobacco element 1650 from reacting with the tobacco element 1650. In an example embodiment, the desired amount of generated vapor to flow through the channel 1680 without passing through the tobacco element 1650 is 65%. Thus, the air channel 1680*a* may be smaller than the tobacco channel 1680*b* in volume. The divider 1660 may positioned at a distance of 65% of a diameter of the housing 6 in a first radial direction of the housing 6 and a distance of 35% of the diameter of the housing 6 in an opposite second radial direction of the housing 6.

The divider 1660 may be 1 mm thick and can be heated to avoid condensation. The length and width of the divider 1660 are dependent on the length and width of the channel 1680*b*. In an example embodiment, the divider 1660 has a same length (in longitudinal direction) and width of the channel 1680*b*, such as 15-25 mm long and 8 mm wide.

In addition, the heated divider 1660 may heat the tobacco element 1650. When heated, the divider 1660 also provides heat to the tobacco element 1650. For example, the divider 1660 and the gasket 10 may be made of a conductive material (e.g., stainless steel). The gasket 10 is connected to the heater 14 to conduct heat to the divider 1660. The divider 1660 may be connected to the heater 14 by a wire along the housing 6 from the heater 14 to the gasket 1560.

Tipping paper 1655 may overlap the filter 1620 and the tobacco element 1650. The tipping paper 1655 may cover surface areas of the tobacco insert 1610 that extend in along the outer tube 6. Thus, the tipping paper 1655 provides stiffness to the tobacco insert 1610, permitting easier insertion to the receiving area 1605. An aluminum foil may also be used to contain the tobacco element 1650, with or without additional tipping paper.

The position of the heater 14 is not limited to the position shown in FIG. 16A. For example, the heater 14 may be positioned at the end of the outer air passage 9 such that the heater 14 is closer to the tobacco element 1650 and/or in contact with the tobacco element 1650. In another example embodiment, the heater 14 may protrude out of the outer air passage 9 in the same manner as shown in FIG. 11B.

The heater 14 may be a set distance from the tobacco element 1650 or contacting the tobacco element 1650 such that the heater 14 heats the tobacco element 1650 to a temperature (as described above) during an application of a negative pressure.

In operation, with non-combustible smoking device 1600 in an assembled configuration, a negative pressure may be applied on the tobacco insert 1610. The negative pressure may cause an internal pressure drop inside non-combustible smoking device 1600 that may cause an inlet air flow to enter the device 1600 via air inlets 44/44'. The internal pressure drop may also cause an internal pressure drop within section 72 as air is drawn through air inlet 44*a* (via an air flow path traveling through section 72). The internal pressure drop formed in section 72 may be sensed by sensor 16. The sensor 16 may then operate to close an electrical circuit that includes the power supply 1. In turn, electrical leads carry an electrical current to heater 14 in order to energize the heater 14. The energized heater 14 in turn heats and vaporizes a portion of the pre-vapor formulation that is drawn toward the heater 14 via the wick 28.

Pre-vapor formulation material is transferred from the pre-vapor formulation supply reservoir 22 and/or pre-vapor formulation storage medium 21 in proximity of the heater 14 by capillary action in the wick 28. When the heater 14 is activated, the pre-vapor formulation in the central portion of the wick 28 is vaporized by the heater 14 to vaporize the pre-vapor formulation material and form generated vapor. Due to a negative pressure being applied, the generated vapor flows from the heater 14, through the tobacco element 1650 and the air channel 1680*a* and out of the filter 1620.

In the example shown in FIG. 16A, the filter 1620 may be a cellulose acetate (CA) filter. CA filter elements, such as triacetin, can be eluted into generated vapor. Vapor phase nicotine and other volatile elements in generated vapor can be reduced by a presence of tobacco.

Figure 16B:
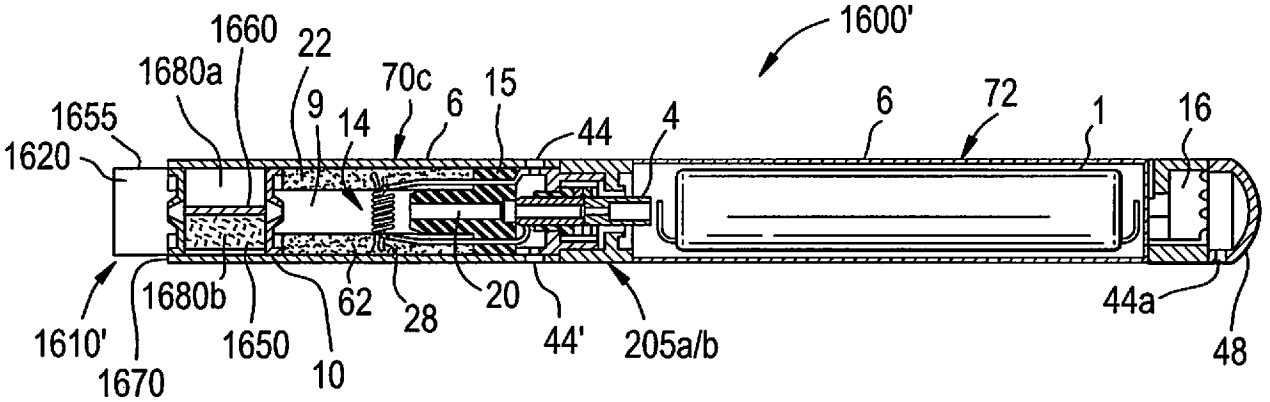
FIG. 16B illustrates an example embodiment of a non-combustible smoking device including a divider in a channel.

FIG. 16B illustrates an example embodiment of a non-combustible smoking device including a divider in a channel.

As shown in FIG. 16B, a non-combustible smoking device 1600' is similar to the non-combustible smoking device 1600. Therefore, only the differences will be described.

As shown, a gasket 1670 is located between the filter 1620 and the channels 1680*a* and 1680*b*. The gasket 1670 increases the stability of a tobacco insert 1610'.

Figure 17:
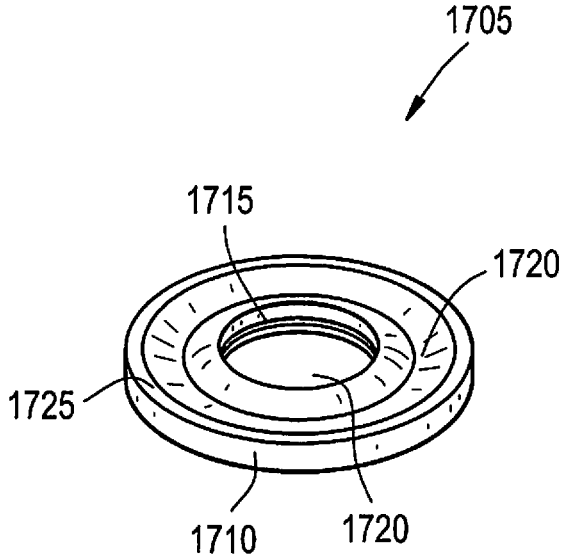
FIG. 17 illustrates a gasket according to an example embodiment.

FIG. 17 illustrates a gasket according to an example embodiment. As shown in FIG. 17, a gasket 1705 includes an outer circular wall 1710 and an inner circular wall 1715. The inner circular wall 1715 defines a cylindrical channel 1720 though the gasket 1705. The inner circular wall 1715 may have the same inner diameter as the receiving portion 1562. In other words, the inner circular wall 1715 is fitted to receive the air flow element 1570. The outer circular wall 1710 and the inner circular wall 1715 are connected together by a bottom portion 1725. The cylindrical channel 1720 has an inner diameter of 2 mm and the gasket has an outer diameter of 8 mm and an inner diameter of 6 mm.

FIGS. 18A-18E illustrate other example embodiments of a tobacco housing. As shown, the example embodiments illustrated in FIGS. 18A-18E illustrate a tobacco housing and a portion of a non-combustible smoking device without the gasket 10. Instead, the gasket 1560 is adjacent the pre-vapor formulation supply reservoir 22. For the sake of brevity, only the differences between the example embodiments of FIGS. 18A-18E and FIGS. 15A-15E will be described.

Figure 18A:
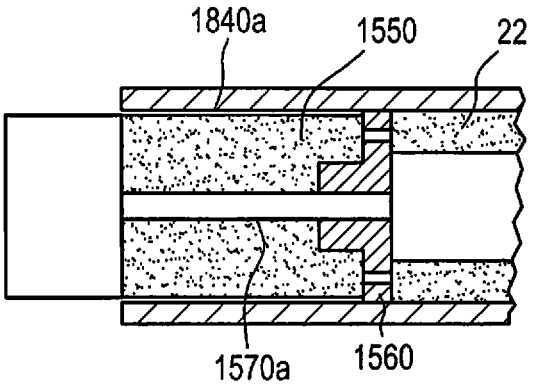
FIGS. 18A-18E illustrate other example embodiments of a tobacco housing.

As shown in FIG. 18A, the gasket 1560 is adjacent the pre-vapor formulation supply reservoir 22. An air flow element 1570*a* extends through the tobacco housing 1840*a*. The tobacco housing 1840*a* and the air flow element 1570*a* are the same as the tobacco housing 1540 and the air flow element, 1570, respectively, except the tobacco housing 1840*a* and the air flow element 1570 are longer due to the absence of the gasket 10.

Figure 18B:
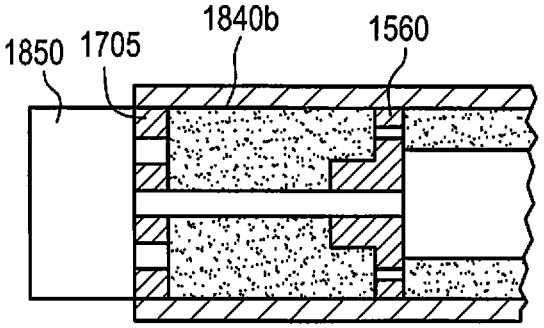

FIG. 18B illustrates a tobacco housing according to another example embodiment. Similar to FIG. 18A, the gasket 1560 defines one end of a tobacco housing 1840*b* and is adjacent to the pre-vapor formulation supply reservoir 22. At an opposite end, the gasket 1705 defines another end of the tobacco housing 1840*b*. The airflow element 1570*a* extends from the channel 9, through the tobacco housing 1840*b* to a mouthpiece 1850. In the embodiments shown in FIGS. 18B-18E, tipping paper may be used to contain the tobacco.

Figure 18C:
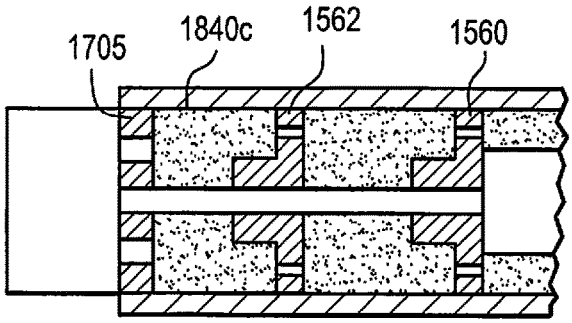

FIG. 18C illustrates a tobacco housing according to another example embodiment. A tobacco housing 1840*c* is the same as the tobacco housing 1840*b*, shown in FIG. 18B, except the tobacco housing 1840*c* includes another gasket 1562 in a middle of the tobacco housing 1840*c*. The gasket 1562 is the same as the gasket 1560.

Figure 18D:
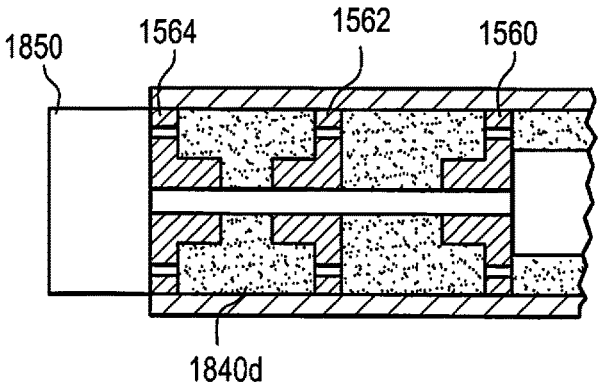

FIG. 18D illustrates a tobacco housing according to another example embodiment. A tobacco housing 1840*d* is the same as the tobacco housing 1840*c*, shown in FIG. 18C, except the tobacco housing 1840*d* includes a gasket 1564 in place of the gasket 1705. The gasket 1564 is the same as the gaskets 1562 and 1560.

Figure 18E:
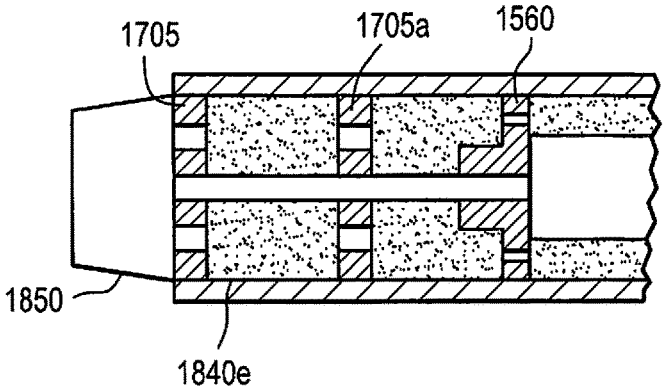

FIG. 18E illustrates a tobacco housing according to another example embodiment. A tobacco housing 1840*e* is the same as the tobacco housing 1840*c*, shown in FIG. 18C, except the tobacco housing 1840*e* includes a gasket 1705*a* in place of the gasket 1562. The gasket 1705*a* is the same as the gasket 1705.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A non-combustible smoking element comprising:

an outer housing;

a pre-vapor formulation reservoir configured to contain a pre-vapor formulation material within the outer housing;

a heater within the outer housing and coupled to the pre-vapor formulation reservoir, the heater being configured to heat at least a portion of the pre-vapor formulation material into a generated vapor and provide the generated vapor to a first portion of a channel;

a tobacco housing within the outer housing at a second portion of the channel, downstream of the pre-vapor formulation reservoir and the heater, and positioned to expose a first portion of the generated vapor to tobacco in the tobacco housing; and at least one air flow channel in the tobacco housing to direct second portion of the generated vapor towards an end of the non-combustible smoking element and prevent the second portion of the generated vapor from entering the tobacco housing.

2. The non-combustible smoking element of claim 1, wherein the air flow channel extends from a first end portion of the tobacco housing to an opposing second end portion of the tobacco housing.

3. The non-combustible smoking element of claim 1, wherein the air flow channel separates the tobacco housing into a first portion and a second portion, the first portion of the tobacco housing being configured to prevent the second portion of the generated vapor from being exposed to the tobacco.

4. The non-combustible smoking element of claim 3, wherein the second portion of the generated vapor is 65 percent of the generated vapor.

5. The non-combustible smoking element of claim 1, wherein the air flow channel is a tube.

6. The non-combustible smoking element of claim 5, wherein the tube has an inside diameter of 0.5 mm to 3 mm.

7. The non-combustible smoking element of claim 6, wherein the tube has an inside diameter of 2 mm to 2.5 mm.

8. The non-combustible smoking element of claim 1, wherein the air flow channel divides the tobacco housing into two sections.

9. The non-combustible smoking element of claim 1, wherein the air flow channel is a tube including one of polyetheretherketone (PEEK), metal or both PEEK and metal.

10. A non-combustible smoking device comprising:

an outer housing;

a pre-vapor formulation reservoir configured to contain a pre-vapor formulation material within the outer housing;

a heater within the outer housing and coupled to the pre-vapor formulation reservoir, the heater being configured to heat at least a portion of the pre-vapor formulation material into a generated vapor and provide the generated vapor to a first portion of a channel;

a power supply configured to supply power to the heater;

a tobacco housing within the outer housing at a second portion of the channel, downstream of the pre-vapor formulation reservoir and the heater, and positioned to expose a first portion of the generated vapor to tobacco in the tobacco housing; and at least one air flow channel in the tobacco housing to direct at least a second portion of the generated vapor towards an end of the non-combustible smoking device and prevent the second portion of the generated vapor from entering the tobacco housing.

11. The non-combustible smoking device of claim 10, wherein the air flow channel extends from a first end portion of the tobacco housing to an opposing second end portion of the tobacco housing.

12. The non-combustible smoking device of claim 10, wherein the air flow channel separates the tobacco housing into a first portion and a second portion, the first portion of the tobacco housing being configured to prevent the second portion of the generated vapor from being exposed to the tobacco.

13. The non-combustible smoking device of claim 12, wherein the second portion of the generated vapor is 65 percent of the generated vapor.

14. The non-combustible smoking device of claim 10, wherein the air flow-channel is a tube.

15. The non-combustible smoking device of claim 14, wherein the tube has an inside diameter of 0.5 mm to 3 mm.

16. The non-combustible smoking device of claim 15, wherein the tube has an inside diameter of 2 mm to 2.5 mm.

17. The non-combustible smoking element of claim 1, further comprising:

a gasket including holes to direct at least the first portion of the generated vapor to the tobacco in the tobacco housing, the at least one air flow channel being coupled to the gasket.

18. The non-combustible smoking device of claim 10, further comprising:

a gasket including holes to direct at least the first portion of the generated vapor to the tobacco in the tobacco housing, the at least one air flow channel being coupled to the gasket.

* * * * *